US008494429B2

(12) United States Patent
Seo et al.

(10) Patent No.: US 8,494,429 B2
(45) Date of Patent: Jul. 23, 2013

(54) IMAGE FORMING APPARATUS AND PROCESS CARTRIDGE

(75) Inventors: Kumiko Seo, Kanagawa (JP); Toshiyuki Kabata, Kanagawa (JP); Hiroshi Nakai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 331 days.

(21) Appl. No.: 12/947,262

(22) Filed: Nov. 16, 2010

(65) Prior Publication Data

US 2011/0129269 A1 Jun. 2, 2011

(30) Foreign Application Priority Data

Dec. 1, 2009 (JP) ..... 2009-273123
Oct. 27, 2010 (JP) ..... 2010-240318

(51) Int. Cl.
*G03G 21/00* (2006.01)

(52) U.S. Cl.
USPC ..... 399/346; 399/123

(58) Field of Classification Search
USPC ..... 399/123, 346
See application file for complete search history.

(56) References Cited

U.S. PATENT DOCUMENTS

| | | | |
|---|---|---|---|
| 3,954,568 | A | 5/1976 | DuPree |
| 7,103,301 | B2 | 9/2006 | Watanabe et al. |
| 7,218,879 | B2 | 5/2007 | Enoki et al. |
| 7,251,437 | B2 | 7/2007 | Tamoto et al. |
| 7,251,438 | B2 | 7/2007 | Watanabe et al. |
| 7,315,711 | B2 | 1/2008 | Ariizumi et al. |
| 7,383,013 | B2 | 6/2008 | Watanabe et al. |
| 7,486,914 | B2 | 2/2009 | Kabata et al. |
| 7,499,664 | B2 | 3/2009 | Koichi et al. |
| 2006/0285897 | A1* | 12/2006 | Sugiura et al. ..... 399/346 |
| 2007/0224528 | A1 | 9/2007 | Yamashita et al. |
| 2009/0116863 | A1 | 5/2009 | Koichi et al. |
| 2009/0279930 | A1 | 11/2009 | Kabata et al. |
| 2010/0034570 | A1 | 2/2010 | Hatakeyama et al. |
| 2010/0178073 | A1 | 7/2010 | Kabata et al. |
| 2010/0278558 | A1 | 11/2010 | Enoki et al. |

FOREIGN PATENT DOCUMENTS

| | | | |
|---|---|---|---|
| CN | 1573620 | A | 2/2005 |
| JP | 52-36016 | | 9/1977 |
| JP | 2000-330441 | A | 11/2000 |
| JP | 2002-97483 | A | 4/2002 |
| JP | 2005-274737 | A | 10/2005 |
| JP | 2006-350240 | A | 12/2006 |
| JP | 2008-134467 | | 6/2008 |

OTHER PUBLICATIONS

Chinese Office Action issued Aug. 30, 2012 in Patent Application No. 201010574289.X.

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

An image forming apparatus including multiple photoreceptors; multiple chargers that charge the respective photoreceptors; a latent image forming device that forms respective latent images on the respective charged photoreceptors; multiple developing devices that develop the respective latent images into respective toner images; multiple transfer devices that transfer the respective toner images onto an intermediate transfer member; multiple cleaning devices that remove residues remaining on the respective photoreceptors after transferring the respective toner images therefrom; and one or more BN-containing protective agent applicators that apply a BN-containing protective agent comprising a metal soap and boron nitride to the respective photoreceptors. The total number of the photoreceptors is N being an integer of 2 or more, and the total number of the BN-containing protective agent applicators is between 1 and N−1.

19 Claims, 5 Drawing Sheets

IMAGE FORMING APPARATUS AND PROCESS CARTRIDGE

CROSS-REFERENCE TO RELATED APPLICATIONS

The present patent application claims priority pursuant to 35 U.S.C. §119 from Japanese Patent Application Nos. 2009-273123 and 2010-240318, filed on Dec. 1, 2009 and Oct. 27, 2010, respectively, each of which is hereby incorporated by reference herein in its entirety.

BACKGROUND

1. Field of the Invention

The present invention relates to an image forming apparatus such as a copier, a printer, and a facsimile, and a process cartridge used therefor.

2. Description of the Background

In electrophotographic image forming apparatuses, images are formed through processes of charging, exposure, development, and transfer. It is likely that discharge products are produced in the charging process and remain on a photoreceptor and that some toner particles remain on the photoreceptor without being transferred in the transfer process. These residual materials remaining on the photoreceptor are removed in an additional process of cleaning.

Generally, such residual materials remaining on the photoreceptor are removed by a rubber blade, which is cheap and structurally simple. The rubber blade is contacted against the photoreceptor so as to frictionally remove the residual materials from the photoreceptor. Therefore, both the rubber blade and the photoreceptor are abraded each other, resulting in their short lifespan. Hereinafter, the rubber blade may be called as the cleaning blade.

On the other hand, widely-used toners have a smaller particle size to meet recent demand for higher image quality. However, disadvantageously, the smaller toner particles more easily pass through the cleaning blade. In a case in which the cleaning blade causes partial vibration due to its poor dimension accuracy or assembly accuracy, small toner particles pass through the cleaning blade much more.

To prevent the above-described problem in removing small toner particles from the photoreceptor, one proposed approach involves supplying lubricant powders to the photoreceptor from a rotary brush contacted against a solid lubricant so that a thin layer of the lubricant is formed on the photoreceptor by pressure from the cleaning blade. The lubricant present between the photoreceptor and the cleaning blade prevents abrasion or deterioration thereof. The lubricant present on the photoreceptor also prevents partial vibration of the cleaning blade, thus preventing toner particles from passing through the cleaning blade.

Most of recent image forming apparatuses employ a charging roller using AC (alternate current) discharge, for charging photoreceptor, which can meet the recent demand for higher image quality. In AC discharge, an alternate current voltage is overlapped with a direct current voltage. Advantageously, such a charging roller using AC discharge also meets demand for downsizing of apparatus, and generates less oxidizing gases such as ozone and NOx. However, AC discharge is more hazardous to the photoreceptor because the photoreceptor is repeatedly exposed to positive and negative electric discharges for 100 to 1,000 times per second, compared to DC (direct current) discharge in which the photoreceptor can be completely charged by exposure to positive discharge only once. Accordingly, it is more important for image forming apparatuses employing AC discharge to protect the photoreceptor.

In view of this situation, there is a need for applying a greater amount of the lubricant to the photoreceptor as a protective agent. Hereinafter, the lubricant may be called as the protective agent. Further, there is another need for more effectively removing smaller toner particles from the photoreceptor. To respond to these needs, the cleaning blade may be required to contact the photoreceptor with a higher pressure. However, this may result in more rapid deterioration of the cleaning blade.

Alternatively, the rotary brush may be required to contact the solid lubricant with a higher pressure to supply a greater amount of lubricant. In this case, however, the scraped off lubricant powders may be larger in size. Such large lubricant powders are difficult to uniformly cover the photoreceptor.

There has been another problem that toner particles or lubricant powders passed through the cleaning blade scatter to contaminate a charging roller.

There has been a tendency that charging rollers and cleaning blades are frequently replaced with new ones whenever they have deteriorated, while various attempts have been made to lengthen lifespan of photoreceptors. Recently, longer lifespan is also required for all members in image forming apparatus including charging roller and cleaning blade, as well as photoreceptor.

Most widely-used protective agents (i.e., lubricants) are comprised of metal soaps. Such metal soap powders are disadvantageous because they considerably pass through the cleaning blade and scatter to contaminate the charging roller. In view of this situation, Japanese Patent Application Publication No. 2008-134467 proposes a protective agent comprised of a metal soap and boron nitride. According to the publication, the protective agent comprised of zinc stearate (i.e., a metal soap) and boron nitride is suppressed from scattering and abrading cleaning blades for an extended period of time. However, the problem is that boron nitride is very expensive.

In attempting to extend the lifespan of electrophotographic image forming members such as photoreceptor, cleaning blade, and charging roller, especially in a case in which a metal soap is applied to the photoreceptor, the inventors of the present invention found that the lifespan of the cleaning blade or charging roller is shortened when too large an amount of the metal soap is applied to the photoreceptor, and the lifespan of the photoreceptor is shortened when too small an amount of the metal soap is applied to the photoreceptor. Accordingly, it is difficult to simultaneously extend the lifespan of all the photoreceptor, cleaning blade, and charging roller when the metal soap is applied to the photoreceptor as a protective agent.

In the above case in which a metal soap is applied to the photoreceptor, the amount of the metal soap particles present on the photoreceptor is relatively large. Meanwhile, in a case in which a mixture of a metal soap with boron nitride is applied to the photoreceptor, the amount of the metal soap particles present on the photoreceptor is drastically reduced, thus suppressing contamination of the charging roller.

Additionally, in the above case in which a metal soap is applied to the photoreceptor, the metal soap particles are likely to pass through the cleaning blade. Meanwhile, in a case in which a mixture of a metal soap with boron nitride was applied to the photoreceptor, the amount of the metal soap particles passed through the cleaning blade is drastically reduced, resulting in drastic extension of the lifespan of the cleaning blade.

Thus, application of the mixture of a metal soap with boron nitride to the photoreceptor can simultaneously extend the lifespan of the photoreceptor, charging roller, and cleaning blade, while providing high quality images for an extended period of time. The problem is, however, that boron nitride is very expensive.

SUMMARY

Exemplary aspects of the present invention are put forward in view of the above-described circumstances, and provide novel image forming apparatus and process cartridge that produce high quality images for an extended period of time without deterioration of image forming members such as photoreceptor, charging roller, cleaning blade, application blade, etc.

In one exemplary embodiment a novel image forming apparatus includes multiple photoreceptors; multiple chargers that charge the respective photoreceptors; a latent image forming device that forms respective latent images on the respective charged photoreceptors; multiple developing devices that develop the respective latent images into respective toner images; multiple transfer devices that transfer the respective toner images onto an intermediate transfer member; multiple cleaning devices that remove residues remaining on the respective photoreceptors after transferring the respective toner images therefrom; and one or more BN-containing protective agent applicators that apply a BN-containing protective agent comprising a metal soap and boron nitride to the respective photoreceptors. The total number of the photoreceptors is N being an integer of 2 or more, and the total number of the BN-containing protective agent applicators is between 1 and N−1.

In another exemplary embodiment, a novel process cartridge detachably mountable on image forming apparatus includes a photoreceptor that bears a latent image; a developing device that develops the latent image into a toner image; and a BN-containing protective agent applicator that applies a BN-containing protective agent comprising a metal soap and boron nitride to the photoreceptor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
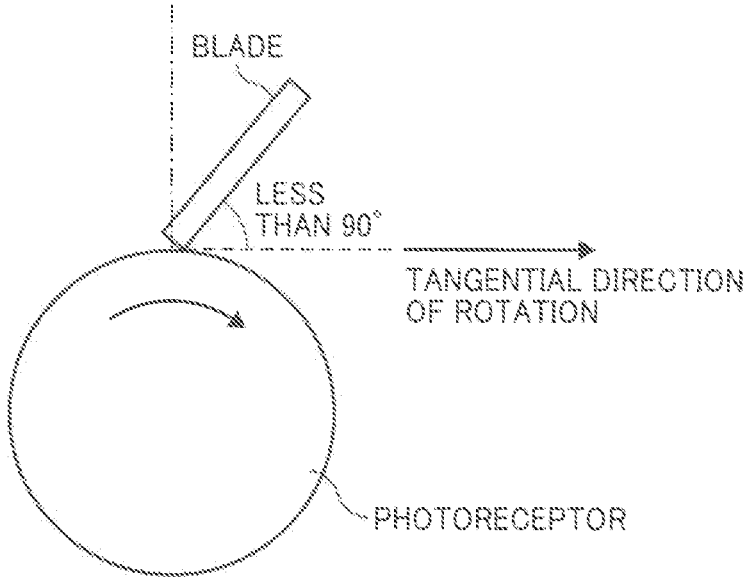
FIG. 1A schematically illustrates a blade which contacts a photoreceptor so as to face in the direction of the photoreceptor.

In seeking how to save boron nitride consumption, for reducing cost, the inventors of the present invention found that even in a case in which a protective agent comprising a metal soap and boron nitride (hereinafter "BN-containing protective agent") is applied to at least one photoreceptor and no protective agent or a protective agent comprising no or less boron nitride is applied to the rest of the photoreceptors, the charging rollers and the cleaning blades corresponding to the photoreceptors without application of the BN-containing protective agent are also prevented from deteriorating.

Further, ICP emission spectrometric analysis reveals that boron nitride exists even on the photoreceptor without application of the BN-containing protective agent, because the BN-containing protective agent is conveyed to all the photoreceptors by an intermediate transfer member. Thus, the BN-containing protective agent has to be applied to at least one photoreceptor.

Accordingly, this specification provides an image forming apparatus including multiple photoreceptors, multiple chargers that charge the respective photoreceptors, a latent image forming device that forms respective latent images on the respective charged photoreceptors, multiple developing devices that develop the respective latent images into respective toner images, multiple transfer devices that transfer the respective toner images onto an intermediate transfer member, multiple cleaning devices that remove residues remaining on the respective photoreceptors after transferring the respective toner images, and one or more BN-containing protective agent applicators that apply a BN-containing protective agent comprising a metal soap and boron nitride to the respective photoreceptors. The total number of the photoreceptors is N being an integer of 2 or more, and the total number of the BN-containing protective agent applicators is between 1 and N−1.

From the viewpoint of performance, the EN-containing protective agent is preferably applied to as many as possible of the photoreceptors. By contrast, from the viewpoint of cost, the BN-containing protective agent has to be applied to at least one of the photoreceptors. It is likely that the protective agent applied to the photoreceptor is undesirably removed by toner particles or external additives released from the toner particles. Therefore, the BN-containing protective agent is preferably applied to a photoreceptor which is most frequently involved in image forming operations, that is, a photoreceptor for forming black images. Additionally, when a specific color toner, a special toner such as gold or silver toner, or a transparent toner that improves image gloss by covering the entire image area, is involved in image forming operations, the BN-containing protective agent is preferably applied to the corresponding photoreceptor.

The boron nitride is transferred from the photoreceptor onto the intermediate transfer member, and further transferred onto the other photoreceptors. Because a part of the boron nitride is transferred from the intermediate transfer member onto paper along with a toner image, the BN-containing protective agent is preferably applied to the extreme upstream photoreceptor.

The boron nitride improves lubricity between the photoreceptor and the cleaning blade and prevents micro-vibration or abrasion of the cleaning blade. Thus, toner particles or the metal soap particles are prevented from passing through the cleaning blade to contaminate the charging roller, providing high image quality.

When the total number of the photoreceptors is N, being an integer of 2 or more, the total number of the BN-containing protective agent applicators that apply the BN-containing protective agent to the respective photoreceptors is between 1 and N−1. In other words, the BN-containing protective agent is applied to 1 to N−1 photoreceptors. In this case, the boron nitride is conveyed to the other photoreceptors to which no boron nitride is applied.

Preferably, the image forming apparatus further includes one or more protective agent applicators that apply a protective agent consisting essentially of a metal soap to the respective photoreceptors other than those to which the BN-containing protective agent is applied. Although the metal soap particles are likely to pass through the cleaning blade and scatter to contaminate the charging roller, the presence of boron nitride conveyed from the other 1 to N−1 photoreceptors by the intermediate transfer member prevents the metal soap particles from passing through the cleaning blade and also prevents the cleaning blade from micro-vibrating. The metal soap is formed into an appropriate thin layer on the photoreceptor.

Preferably, the weight ratio of the metal soap to the born nitride in the BN-containing protective agent is between 60/40 to 97/3, and more preferably between 75/25 to 85/15.

When the weight ratio of the metal soap is too small, too large an amount of boron nitride may adhere to the photoreceptor and cause trouble. When the weight ratio of the metal soap is too large, boron nitride cannot exert its effort.

The BN-containing protective agent may optionally include abrasive particles for removing contaminants on the photoreceptor. The abrasive particles can further remove excessive boron nitride particles from the photoreceptor. Specific preferred materials for the abrasive particles include, but are not limited to, fine particles of metal oxides or metal complex oxides such as aluminum oxide (alumina), silicon oxide, titanium oxide, zirconium oxide, cerium oxide, strontium titanate, and magnesium aluminometasilicate; and fine particles of organic materials such as silicone resins and silicone rubbers.

Among the above materials, alumina is preferable. The content of alumina is preferably from 2 to 15% by weight, more preferably from 3 to 10% by weight, and most preferably from 4 to 8% by weight, based on the total weight of the BN-containing protective agent. When the content of alumina is too large, alumina may cause abrasion on the photoreceptor. When the content of alumina is too small, contaminants or excessive protective agents may not be sufficiently removed.

The alumina preferably has a particle diameter of from 0.05 to 0.5 μm, more preferably from 0.1 to 0.4 μm, and most preferably from 0.2 to 0.3 μm. When the particle diameter is too small, contaminants or excessive protective agents may not be sufficiently removed. When the particle diameter is too large, alumina may cause abrasion on the photoreceptor.

Preferably, the metal soap is a mixture of zinc palmitate and zinc stearate. The weight ratio of zinc palmitate to zinc stearate in the metal soap is preferably from 75/25 to 40/60, and more preferably from 66/34 to 40/60.

When a rotary brush scrapes a solid block of zinc stearate into fine particles and supplies them to the photoreceptor, the fine particles are extended over the photoreceptor by the cleaning blade. However, when the linear speed of the photoreceptor is relatively high, extension of the zinc stearate cannot keep up with the linear speed.

In a case in which a mixture of zinc stearate and zinc palmitate is applied to the photoreceptor, the mixture can be satisfactorily extended over the photoreceptor by the cleaning blade even when the linear speed of the photoreceptor is high, because zinc palmitate has a smaller molecular weight than zinc stearate. This is the reason why the mixture of zinc stearate and zinc palmitate is preferable.

Both zinc stearate and zinc palmitate are metal salts of fatty acids. The number of fatty-acid-origin carbon atoms in zinc stearate and zinc palmitate is 18 and 16, respectively. Since the chemical structures of zinc stearate and zinc palmitate are similar, they are compatible with each other and behave as substantially the same material.

A mixture of zinc stearate with a specific amount of zinc palmitate can be more easily extended over the photoreceptor by the cleaning blade compared to zinc stearate alone, because the melting point of zinc palmitate is lower than that of zinc stearate.

As the linear speed of the photoreceptor becomes faster, the photoreceptor receives more charging energy, especially AC charging energy. In this case, the photoreceptor needs to be protected more effectively by thickening the protective agent layer on the photoreceptor.

Zinc stearate molecules are likely to adhere to the photoreceptor in bimolecular state, rather than in monomolecular state, in terms of stability. Accordingly, the saturated thickness of the zinc stearate layer is equal to the thickness of its bimolecular layer.

In a case in which a specific amount of zinc palmitate is mixed with zinc stearate, the thickness of the resulting molecular layer varies by location because zinc palmitate has a shorter molecular length than zinc stearate. In this case, molecules are likely to accumulate on shorter portions, thereby consequently forming a thicker layer having better protection effect than the bimolecular layer.

The image forming apparatus according to this specification may further include an application blade that extends protective agents over the photoreceptor. Of course, protective agents can be extended over the photoreceptor only by the cleaning blade. However, because the primary function of the cleaning blade is to remove residual toner particles, the residual toner particles and the protective agent particles are often mixed on the cleaning blade, avoiding normal formation of a protective agent layer on the photoreceptor. Thus, it is preferable that the application blade and the cleaning blade are separately provided.

Preferably, the application blade is coated with a lubricant before coming into use, to initially improve lubricity between the application blade and the photoreceptor.

Additionally, the application blade is preferably coated with boron nitride or a mixture of a metal soap and boron nitride before coming into use, to extend the lifespan of the application blade, photoreceptor, and charging roller. Boron nitride prevents protective agent particles from passing though the application blade and scattering to contaminate the charging roller. Further, boron nitride improves lubricity between the photoreceptor and the application blade and prevents micro-vibration of the application blade. Thus, the protective agent particles are prevented from passing through the application blade and contaminating the charging roller, resulting in production of high image quality.

The application blade may contact the photoreceptor so as to face in the direction of rotation of the photoreceptor, while forming an angle less than 90° between the tangential direction of rotation of the photoreceptor, as illustrated in FIG. 1A.

Figure 1B:
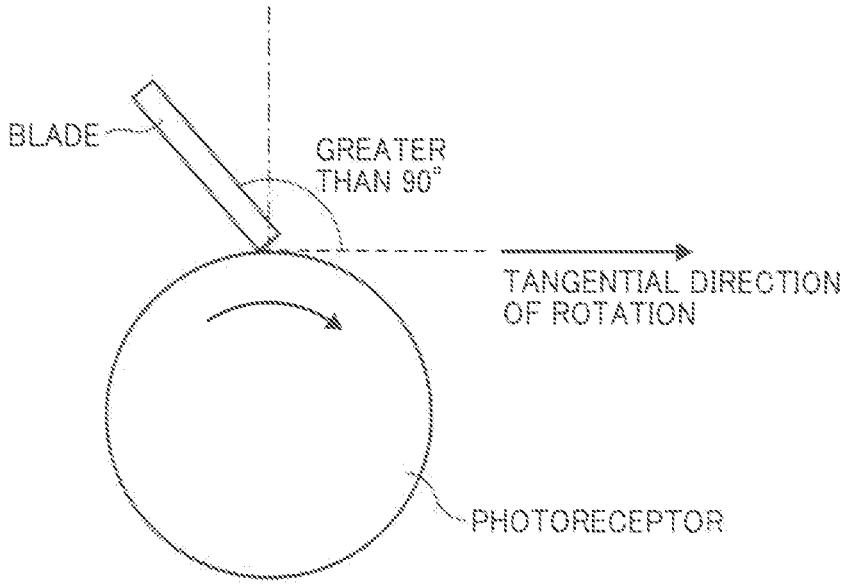
FIG. 1B schematically illustrates a blade which contacts a photoreceptor so as to trail the photoreceptor.

Alternatively, the application blade may contact the photoreceptor so as to trail the photoreceptor, while forming an angle greater than 90° between the tangential direction of rotation of the photoreceptor, as illustrated in FIG. 1B.

The former case in which the application blade contacts the photoreceptor so as to face in the direction of rotation of the photoreceptor is more preferable because excessive application of boron nitride can be prevented.

The application blade according to this specification preferably has an obtuse edge, although highly manufacturable application blades having a rectangular edge are widely-used.

Figure 2A:
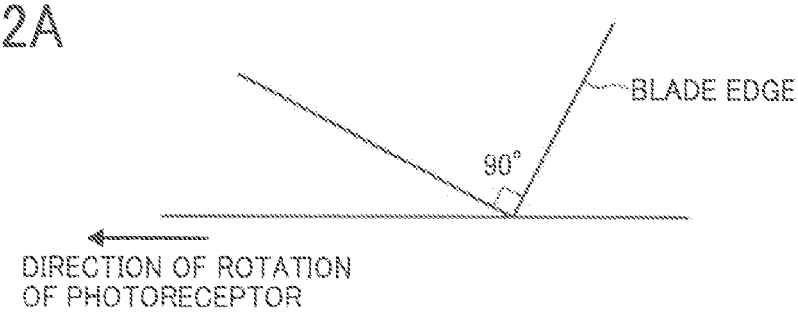
FIG. 2A schematically illustrates a blade having a rectangular edge.
Figure 2B:
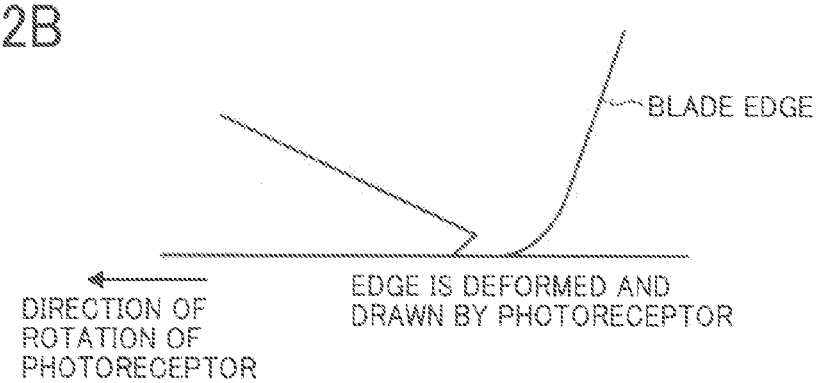
FIG. 2B schematically illustrates a blade which is deformed and drawn by rotation of a photoreceptor.

FIG. 2A schematically illustrates a blade having a rectangular edge. Such a rectangular edge is likely to be deformed and drawn by rotation of the photoreceptor, as illustrated in FIG. 2B.

Figure 2C:
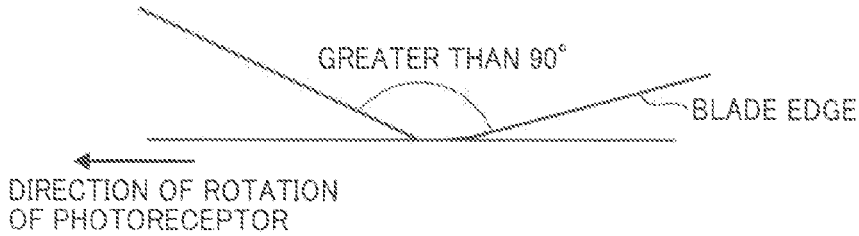
FIG. 2C schematically illustrates a blade having an obtuse edge.

FIG. 2C schematically illustrates a blade having an obtuse edge. Such an obtuse edge is very unlikely to be deformed and drawn by rotation of the photoreceptor. Such a blade having an obtuse edge reliably contacts the photoreceptor without causing micro-vibration, thus protective agent particles are prevented from passing though the blade.

Figure 2D:
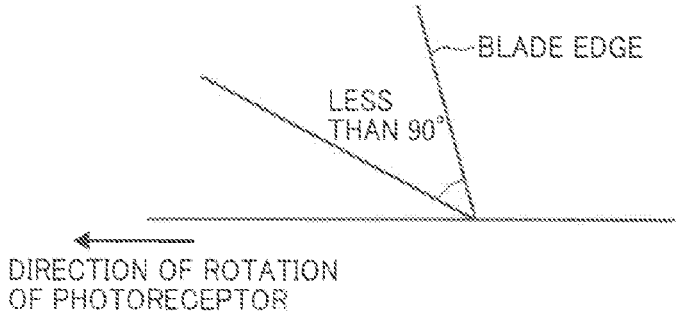
FIG. 2D schematically illustrates a blade having an acute edge.

FIG. 2D schematically illustrates a blade having an acute edge. Such a rectangular edge is very likely to be deformed and drawn by rotation of the photoreceptor, which is not preferable.

Accordingly, the blade having an obtuse edge most reliably contacts the photoreceptor without causing micro-vibration and prevents boron nitride and metal soap particles from passing through the application blade and contaminating the charging roller.

The protective agent applicator (including the BN-containing protective agent applicator) preferably includes a solid bar of a protective agent and a rotary brush contacted against the solid bar. Such a simple configuration can reliably supply the protective agent to the photoreceptor at low cost.

The solid bar is preferably prepared by compressing powders of the protective agent. The degree of compression determines the hardness of the resulting solid bar. The degree of compression can be controlled considering the absolute specific gravity and weight of the protective agent used.

Preferably, the solid bar has an absolute specific gravity of from 88 to 98%, more preferably from 90 to 95%, that of the protective agent. When the solid bar has too small an absolute specific gravity, such a solid bar may easily break due to its poor mechanical strength. Only a high-power pressing machine can prepare a solid bar having too large an absolute specific gravity, but such a solid bar may be partially melt or the hardness thereof may vary by location.

The solid bar having an absolute specific gravity of from 88 to 98%, prepared by compressing the protective agent powder, is easily granulated even when the pressing force form the rotary brush is relatively low. The rotary brush can reliably scrape such a solid bar and apply the granulated protective agent to the photoreceptor for an extended period of time without deteriorating. When the protective agent comprises boron nitride and/or alumina, it is preferable that these materials are sufficiently mixed before compressed so that the resulting solid bar maintains the mixing state.

The photoreceptor is preferably charged by a contact or adjacent charging method employing AC (alternate current) discharge in which an alternate current voltage is overlapped with a direct current voltage. However, AC discharge is more hazardous to the photoreceptor because the photoreceptor is repeatedly exposed to positive and negative electric discharges for 100 to 1,000 times per second, compared to DC (direct current) discharge in which the photoreceptor can be completely charged by exposure to positive discharge only once. Accordingly, it is more effective for the BN-containing protective agent to protect the photoreceptor employing AC discharge compared to that employing DC discharge.

The photoreceptor preferably includes filler particles in its outermost layer. In this case, the BN-containing protective agent can effectively prevent the cleaning and/or application blade from being deteriorated by such filler particles. Also, even if the filler particles make the photoreceptor surface irregular to avoid formation of a uniform layer of a metal soap, the BN-containing protective agent can prevent micro-vibration of the blades.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 3:
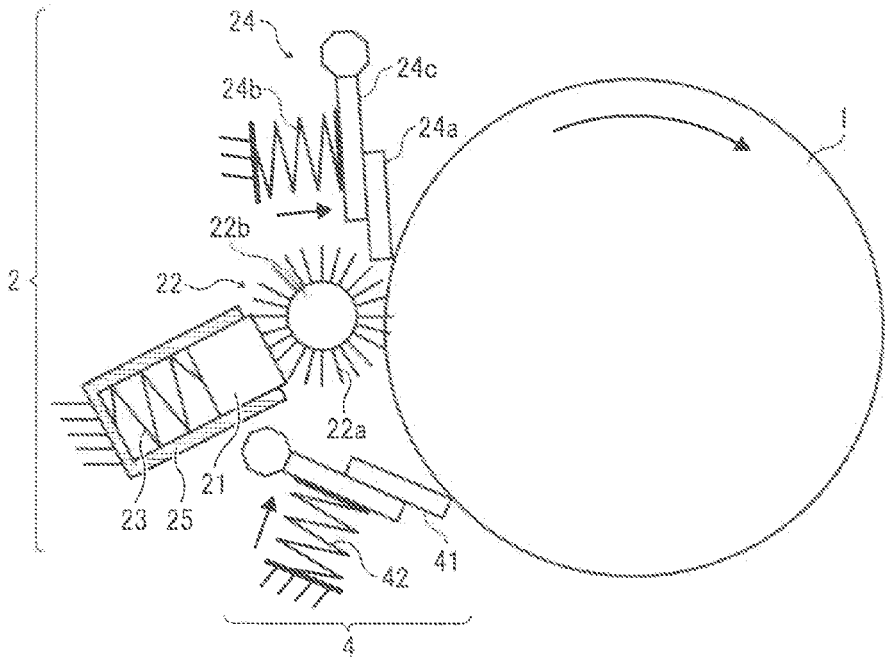
FIG. 3 schematically illustrates a cross-sectional view of an image forming apparatus according to a first exemplary embodiment.

FIG. 3 schematically illustrates a cross-sectional view of an image forming apparatus according to a first exemplary embodiment.

A protective agent applicator 2 is provided facing a drum-shaped photoreceptor 1 serving as an image bearing member. The protective agent applicator 2 includes a protective agent bar 21 comprised of a metal soap and boron nitride (i.e., a BN-containing protective agent), a protective agent bar support 25, a protective agent supply member 22, a pressing mechanism 23, and a protective agent layer forming mechanism 24.

The protective agent bar 21 may have a cylindrical, rectangular, or hexagonal shape, for example. The protective agent supply member 22 further includes a brush 22*a* that is contacted against the protective agent bar 21 to scrape it and supply it to the photoreceptor 1, and a support 22*b*. The pressing mechanism 23 presses the protective agent bar 21 against the brush 22*a* so that the protective agent migrates to the brush 22*a*. The pressing mechanism 23 may be, for example, a spring. The protective agent layer forming mechanism 24 forms a thin layer of the protective agent on the photoreceptor 1. The protective agent bar 21 can be formed by a series of processes of melting, molding, and cooling of the protective agent, or compressing the protective agent powders.

A cleaning device 4 is provided upstream from the protective agent applicator 2 relative to the direction of rotation of the photoreceptor 1. The cleaning device 4 removes residues on the photoreceptor 1 before the protective agent is applied thereto.

The pressing mechanism 23 presses the protective agent bar 21 against the brush 22*a* so that the protective agent migrates from the protective agent bar 21 to the brush 22*a*. Thus, the amount of the protective agent supplied to the photoreceptor 1 is variable by varying the pressing force of the pressing mechanism 23. The brush 22*a* rotates at a different linear speed from that of the photoreceptor 1 so as to slidably contact the surface of the photoreceptor 1 while supplying the protective agent thereto.

The protective agent layer forming mechanism 24, that forms a uniform thin layer of the protective agent on the photoreceptor 1, includes a blade member 24*a* and a pressing member 24*b* that presses the blade member 24*a* against the photoreceptor 1. The pressing member 24*b* may be a spring, for example. The blade member 24*a* is previously covered with a lubricant powder before coming into use.

Specific preferred materials for the lubricant powder that covers the blade member 24*a* include, but are not limited to, metal salts of fatty acids (e.g., zinc stearate, magnesium stearate, iron stearate, calcium stearate, zinc laurate, zinc palmitate, zinc oleate), fluorocarbon resins (e.g., polytetrafluoroethylene (PTFE), poly(perfluoroalkyl ether) (PFA), perfluoroethylene-perfluoropropylene copolymer (FEP), polyvinylidene fluoride (PVDF), ethylene-tetrafluoroethylene copolymer (ETFE)), silicone resins (e.g., polymethyl silicone, polymethyl phenyl silicone), acrylic resins, ethylene-acrylic resins, and inorganic solid lubricants (e.g., mica, boron nitride, molybdenum disulfide, tungsten disulfide, kaolin, montmorillonite, calcium fluoride, graphite).

Among the above lubricants, inorganic solid lubricants are preferable because they can effectively protect the surface of the photoreceptor 1 without adversely affecting chargeability or fluidity of a developer in use. Additionally, inorganic solid lubricants have better resistance to electric stresses compared to metal salts of fatty acids or resin particles, and are unlikely to deteriorate. Thus, inorganic solid lubricants can contribute to extension of lifespan of the blade member 24*a*.

In particular, boron nitride is most preferable among various inorganic solid lubricants because it makes the blade member 24*a* reliably contacts the photoreceptor 1 and prevents protective agent particles from passing through the blade member 24*a*. Inorganic solid lubricants may be surface-treated to have hydrophobicity. The blade member 24*a* preferably contacts the photoreceptor 1 so as to face in the direction of rotation of the photoreceptor 1.

The protective agent layer forming mechanism 24 reliably forms a thin layer of the protective agent on the photoreceptor 1. Thus, the image forming apparatus produces high-quality images for an extended period of time without contaminating the charging roller or frequently replacing consumable supplies.

In the present embodiment, the protective agent is supplied to the surface of the photoreceptor 1 from the protective agent bar 21. Alternatively, the protective agent in a powder state may be directly supplied to the photoreceptor 1. In such a case, a container for containing the protective agent powder and a feeding device for feeding the protective agent powder are needed, while the protective agent bar 21, the pressing mechanism 23, and the protective agent supply member 22 are not needed. The feeding device may be, for example, a pump or an auger.

The blade member 24*a* may be comprised of, for example, elastic materials such as urethane rubber, hydrin rubber, silicone rubber, and fluorocarbon rubber, or a mixture thereof. The portion of the blade member 24*a* where contacts the photoreceptor 1 may be coated with a low-friction-coefficient material by dip coating, for example. The elastic material may include an organic and/or inorganic filler to control the hardness.

The blade member 24*a* is fixedly adhered or fused to a blade support 24*c*, so that a leading edge of the blade member 24*a* is pressed against the photoreceptor 1. The blade member 24*a* preferably has a thickness of from 1 to 15 mm, and more preferably from 2 to 10 mm.

Alternatively, the blade member 24*a* may be an elastic metallic blade, such as a platy spring, the surface of which is coated with a layer of a resin, a rubber, or an elastomer, with an optional intervening coupling agent or primer, by dip coating, for example. The resulting surface layer may be further subjected to thermal hardening or surface polishing, if needed.

Such an elastic metallic blade preferably has a thickness of from 0.05 to 3 mm, and more preferably from 0.1 to 1 mm.

The elastic metallic blade fixed to the blade support 24*c* may be bent to a direction substantially parallel to the support axis so as not to twist.

The surface layer may be comprised of a fluorocarbon resin (e.g., PFA, PTFE, FEP, PVDF), a fluorocarbon rubber, or a silicone elastomer (e.g., methyl phenyl silicone elastomer), for example. The surface layer may further include a filler, if needed.

The pressing member 24*b* presses the blade member 24*a* against the photoreceptor 1 with a linear pressure of from 5 to 80 gf/cm, and more preferably from 10 to 60 gf/cm, so that the protective agent is extended over the surface of the photoreceptor 1 to form a thin protective layer thereon.

The brush 22*a* is preferably comprised of a flexible material so that the photoreceptor 1 is less mechanically stressed.

Specific preferred flexible materials for the brush 22*a* include, but are not limited to, polyolefin resins (e.g., polyethylene, polypropylene), polyvinyl or polyvinylidene resins (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone), vinyl chloride-vinyl acetate copolymers, styrene-acrylic acid copolymers, styrene-butadiene resins, fluorocarbon resins (e.g., polytetrafluoroethylene, polyvinyl fluoride, polyvinylidene fluoride, polychlorotrifluoroethylene), polyester, nylon, acryl, rayon, polyurethane, polycarbonate, phenol resins, and amino resins (e.g., urea-formaldehyde resin, melamine resin, benzoguanamine resin, urea resin, polyamide resin). Two or more of the above resins can be used in combination.

Further, diene rubbers, styrene-butadiene rubbers (SBR), ethylene propylene rubbers, isoprene rubbers, nitrile rubbers, urethane rubbers, silicone rubbers, hydrin rubbers, or norbornene rubbers may be mixed with the above resins so as to control the flexibility.

The support 22*b* may be either a fixed member or a rotatable roll member. For example, the support 22*b* may be a rotatable metallic roll around which a pile fabric tape composing the brush 22*a* is spirally wound. Each brush fiber of the brush 22*a* preferably has a fiber diameter of from 10 to 500 μm, and more preferably from 20 to 300 μm. When the fiber diameter is too small, the speed of supply of the protective agent to the photoreceptor 1 may be too slow. When the fiber diameter is too large, the fiber density of the brush 22*a* may be too low. Such a sparse brush not only causes uneven application of the protective agent to the photoreceptor 1 but also scrapes the protective agent bar 21 with a stronger force, which results in a short lifespan of the protective agent bar 21. Further, the scraped protective agent particles may contaminate the charging roller or increase torque for rotating the brush 22*a* or the photoreceptor 1 because they are very large in size.

Each of the brush fibers preferably has a length of from 1 to 15 mm, and more preferably from 3 to 10 mm. When the brush fiber is too short, the support 22*b* is located too close to the photoreceptor 1, thus probably scratching the photoreceptor 1. When the brush fiber is too long, the brush fiber contacts the protective agent bar 21 or the photoreceptor 1 with too weak a force, resulting in insufficient supply of the protective agent to the photoreceptor 1 or undesirable falling of the brush fibers.

The density of the brush fibers is preferably from 10,000 to 300,000 fibers per square inch (i.e., from $1.5\times10^7$ to $4.5\times10^8$ fibers per square meter). When the density is too low, the protective agent may be unevenly applied to the photoreceptor 1. To increase the density, however, each of the brush fibers is required to have a much smaller diameter, which is not preferable.

From the viewpoint of reliable and uniform supply of the protective agent, the density of the brush fiber is preferably as high as possible. Alternatively, each of the brush fibers may be comprised of several to several hundreds of micro fibers. For example, one brush fiber may be comprised of a bunch of 50 micro fibers each being 6.7 decitex (i.e., 6 denier). In this case, the resulting brush fiber is calculated to be 333 decitex=6.7 decitex×50 fibers (i.e., 300 denier=6 denier×50 fibers).

Most preferably, the brush 22*a* is comprised of single fibers each having a diameter of from 28 to 43 μm, preferably from 30 to 40 μm. In this case, the protective agent can be effectively supplied to the photoreceptor 1. Because twisted fibers generally have a nonuniform diameter, they have been defined by units such as denier and decitex. On the other hand, because single fibers generally have a uniform diameter, they have been defined by the diameter.

When the diameter is too small, the protective agent may be supplied to the photoreceptor 1 at a low efficiency. When the diameter is too large, such a single fiber may be rigid and scratch the photoreceptor 1. The single fibers having a diameter of from 28 to 43 μm are preferably implanted by electrostatic implant so as to be vertical to the support 22*b* as much as possible. The electrostatic implant includes the processes of applying an adhesive to the support 22*b*, charging the support 22*b*, flying the single fibers having a diameter of from 28 to 43 μm by electrostatic force toward the adhesive on the charged support 22*b*, and curing the adhesive. Thus, the resulting brush has a density of from 50,000 to 600,000 fibers per square inch.

The brush fibers may have a coating layer on their surface so as to have a uniform surface profile and an improved environmental stability. The coating layer is preferably comprised of a flexible material which can deform along with deformation of the brush fibers. Specific preferred materials for such coating layer include, but are not limited to, polyolefin resins (e.g., polyethylene, polypropylene, chlorinated polyethylene, chlorosulfonated polyethylene), polyvinyl or polyvinylidene resins (e.g., polystyrene, acrylic resin such as polymethyl methacrylate, polyacrylonitrile, polyvinyl acetate, polyvinyl alcohol, polyvinyl butyral, polyvinyl chloride, polyvinyl carbazole, polyvinyl ether, polyvinyl ketone), vinyl chloride-vinyl acetate copolymers, silicone resins comprising organosiloxane bonds and modified silicone resins (e.g., alkyd-modified, polyester-modified, epoxy-modified, polyurethane-modified silicone resins), fluorocarbon resins (e.g., perfluoroalkyl ether, polyfluorovinyl, polyfluorovinylidene, polychlorotrifluoroethylene), polyamide, polyester, polyurethane, polycarbonate, amino resins (e.g., urea-formaldehyde resin), epoxy resins, and mixtures thereof.

Figure 4:
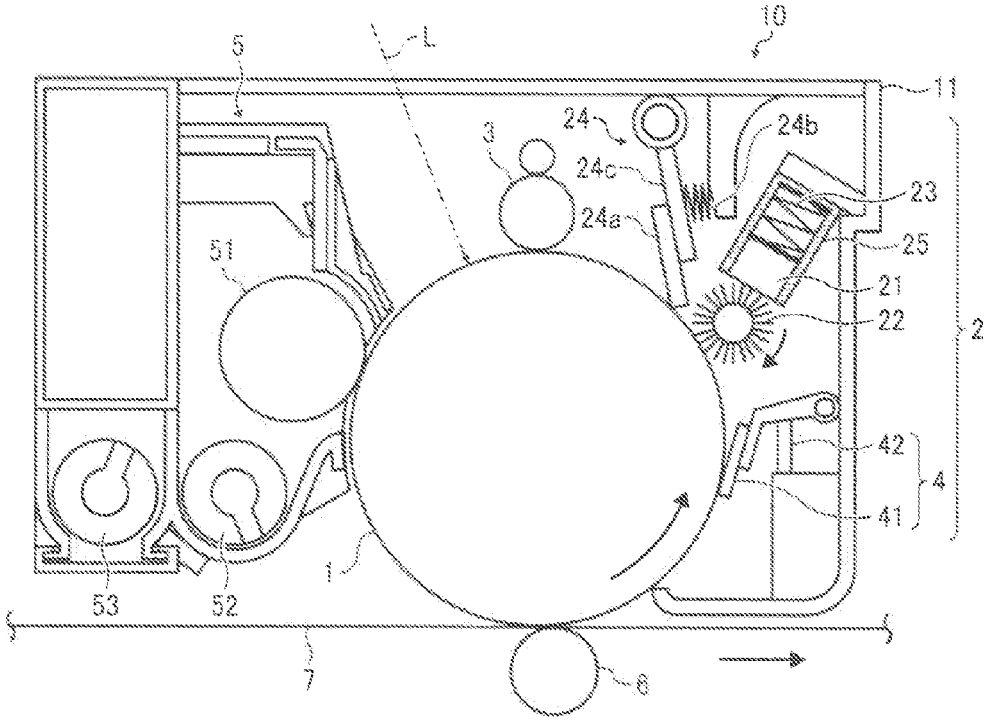
FIG. 4 schematically illustrates a cross-sectional view of a process cartridge according to a second exemplary embodiment.

FIG. 4 schematically illustrates a cross-sectional view of a process cartridge according to a second exemplary embodiment.

Referring to FIG. 4, an image forming part 10 includes a drum-shaped photoreceptor 1 serving as an image bearing member; a charger 3 that charges the photoreceptor 1; a latent image former, not shown, that directs a laser light beam L onto the charged photoreceptor 1 to form an electrostatic latent image thereon; a developing device 5 that develops the electrostatic latent image into a toner image; a transfer device 6 that transfers the toner image from the photoreceptor 1 onto a transfer medium or an intermediate transfer medium 7; a cleaning device 4 that removes residual toner particles remaining on the photoreceptor 1 after image transfer; and a protective agent applicator 2. The photoreceptor 1, the protective agent applicator 2, the charger 3, the developing device 5, and the cleaning device 4 are provided within a process cartridge 11. The cleaning device 4 can be regarded as a part of the protective agent applicator 2 because the cleaning device 4 removes residues on the photoreceptor 1 so that a protective agent is reliably applied thereto.

The charger 3 may be, for example, an AC charging roller to which a voltage in which a direct current (DC) voltage is overlapped with an alternate current (AC) voltage is applied from a high-voltage supply, not shown. The developing device 5 includes a developing roller 51 that feeds a developer comprising toner particles and optional carrier particles, and agitation and feed members 52 and 53 that agitate and feed the developer.

The protective agent applicator 2 is provided facing the photoreceptor 1. The protective agent applicator 2 includes a protective agent bar 21, a protective agent supply member 22, a pressing mechanism 23, a protective agent layer forming mechanism 24, and a protective agent bar support 25.

The cleaning device 4 includes a cleaning member 41 and a pressing mechanism 42. The cleaning member 41 removes residues, i.e., partially deteriorated protective agent and toner particles, after image transfer. In FIG. 4, the cleaning member 41 has a blade-like shape, and is supported by the pressing mechanism 42. The cleaning member 41 contacts the photoreceptor 1 so as to face in the direction of rotation of the photoreceptor 1.

The protective agent layer forming mechanism 24 includes a blade member 24*a*. The blade member 24*a* also contacts the photoreceptor 1 so as to face in the direction of rotation of the photoreceptor 1.

After the cleaning device 4 removes residual toner particles or deteriorated protective agents from the photoreceptor 1, the protective agent supply member 22 supplies the protective agent to the photoreceptor 1 from the protective agent bar 21. The blade member 24*a* in the protective agent layer forming mechanism 24 then forms a thin layer of the protective agent on the photoreceptor 1.

The photoreceptor 1 having the protective agent layer thereon is then charged by the charger 3 and exposed to the laser light beam L so that an electrostatic latent image is formed thereon. The developing device 5 develops the electrostatic latent image into a toner image. The toner image is transferred from the photoreceptor 1 onto the transfer medium (e.g., paper) or intermediate transfer medium 7 by the transfer device 6.

As described above, in the present embodiment, the charger 3 is a charging roller that is compact and produces less oxidizing gases (e.g., ozone). The charger 3 may be hereinafter referred to as the charging roller 3.

The charging roller 3 is provided so as to contact the photoreceptor 1, or alternatively, 20 to 100 μm apart from the photoreceptor 1. The charging roller 3 charges the photoreceptor 1 upon application of a voltage, in which a direct current voltage is overlapped with an alternate current voltage, between the charging roller 3 and the photoreceptor 1 by AC discharge. However, the photoreceptor 1 seems to deteriorate by repeated exposure to electric discharges for more than several hundred times per second in the AC discharge. The protective agent also seems to deteriorate by the AC discharge. Therefore, it is very important to keep a constant amount of the protective agent present on the photoreceptor 1.

The charging roller 3 is preferably comprised of a conductive substrate, a polymer layer, and a surface layer.

The conductive substrate functions as an electrode and a support. Specific preferred materials for the conductive support include, but are not limited to, conductive materials such as metals and alloys (e.g., aluminum, copper alloy, stainless steel), chrome-plated or nickel-plated iron, and resins to which a conductive agent is added.

The polymer layer preferably has a resistivity of from $10^6$ to $10^9$ Ωcm. The resistivity can be controlled by addition of a conductive agent. Specific preferred polymers suitable for the polymer layer include, but are not limited to, polyester-based or olefin-based thermoplastic elastomers, styrene-based thermoplastic resins (e.g., polystyrene, styrene-butadiene copolymer, styrene-acrylonitrile copolymer, styrene-butadiene-acrylonitrile copolymer), and rubbers (e.g., isoprene rubber, chloroprene rubber, epichlorohydrin rubber, butyl rubber, urethane rubber, silicone rubber, fluorocarbon rubber, styrene-butadiene rubber, butadiene rubber, nitrile rubber, ethylene propylene rubber, epichlorohydrin-ethylene oxide copolymerized rubber, epichlorohydrin-ethylene oxide-allyl glycidyl ether copolymerized rubber, ethylene-propylene-diene ternary copolymerized rubber (EPDM), acrylonitrile-butadiene copolymerized rubber, natural rubber, blended rubbers). Among these rubbers, silicone rubber, ethylene propylene rubber, epichlorohydrin-ethylene oxide copolymerized rubber, epichlorohydrin-ethylene oxide-allyl glycidyl ether copolymerized rubber, acrylonitrile-butadiene copolymerized rubber, and blended rubbers are preferable. These rubbers may be either foamed or non-foamed.

The conductive agent may be an electronic conducive agent or an ionic conductive agent. Specific preferred materials suitable for the electronic conductive agent include, but are not limited to, carbon blacks (e.g., ketjen black, acetylene black), pyrolytic carbon, graphite, conductive metals and alloys (e.g., aluminum, copper, nickel, stainless steel), conductive metal oxides (e.g., tin oxide, indium oxide, titanium oxide, tin oxide-antimony oxide solid solution, tin oxide-indium oxide solid solution), and insulative materials which are surface-treated to have conductivity. Specific preferred materials suitable for the ionic conductive agent include, but are not limited to, perchlorates and chlorates of tetraethyl ammonium or lauryl trimethyl ammonium, and perchlorates and chlorates of alkali metals and alkaline earth metals such as lithium and magnesium. Two or more of these conductive agents can be used in combination. The content of the electronic conductive agent is preferably from 1 to 30 parts by weight, more preferably from 15 to 25 parts by weight, based on 100 parts by weight of the polymer. The content of the ionic conductive agent is preferably from 0.1 to 5.0 parts by weight, more preferably from 0.5 to 3.0 parts by weight, based on 100 parts by weight of the polymer.

The surface layer comprises a polymer and has a dynamic ultramicrohardness of from 0.04 to 0.5. Specific preferred polymers suitable for the surface layer include, but are not limited to, polyamide, polyurethane, polyvinylidene fluoride, tetrafluoroethylene copolymer, polyester, polyimide, silicone resin, acrylic resin, polyvinyl butyral, ethylene-tetrafluoroethylene copolymer, melamine resin, fluorocarbon rubber, epoxy resin, polycarbonate, polyvinyl alcohol, cellulose, polyvinylidene chloride, polyvinyl chloride, polyethylene, and ethylene-vinyl acetate copolymer.

Among these polymers, polyamide, polyvinylidene fluoride, tetrafluoroethylene copolymer, polyester, and polyimide are preferable from the viewpoint of releasability from toner. Two or more of the above-described polymers can be used in combination. The above-described polymers preferably have a number average molecular weight of from 1,000 to 100,000, and more preferably from 10,000 to 50,000.

The surface layer further comprises a conductive agent and/or a particulate material. Specific preferred materials suitable for the conductive agent include above-described conductive agents suitable for the polymer layer. Specific preferred materials suitable for the particulate material include, but are not limited to, metal oxides and complex metal oxides (e.g., silicon oxide, aluminum oxide, barium titanate) and fine polymer particles (e.g., tetrafluoroethylene, vinylidene fluoride). Two or more of these materials can be used in combination.

The developing device 5 brings a developer into contact with the photoreceptor 1 so that an electrostatic latent image formed on the photoreceptor 1 is developed into a toner image. The developer may be either a two-component developer comprising toner particles and carrier particles or a one-component developer comprising toner particles and no carrier particle.

As illustrated in FIG. 4, the developing roller 51 is exposed at an opening provided on a casing of the developing device 5.

Toner particles are supplied from a toner bottle, not shown, to the developing device 5, and then agitated and fed toward the developing roller 51 by the agitation and feed members 52 and 53. The developing roller 51 is comprised of a magnetic roller that generates a magnetic field and a developing sleeve that coaxially rotates around the magnetic roller. The carrier particles are formed into multiple linear aggregates that stand on the developing roller 51 by the magnetic force generated from the magnetic roller, and then fed to a developing area where the developing roller 51 faces the photoreceptor 1. In the developing area, the surface of the developing roller 51 moves in the same direction as the surface of the photoreceptor 1 but at a different speed from the photoreceptor 1. The linear aggregates of the carrier particles standing on the photoreceptor slidably contacts the surface of the photoreceptor 1 so that toner particles adhered to the carrier particles are supplied to the surface of the photoreceptor 1. At that same time, a developing bias is applied to the developing roller 51 from a power source, not shown, to form a developing electric field within the developing area. Toner particles on the developing roller 51 migrate toward an electrostatic latent image on the photoreceptor 1 due to an electrostatic force, and finally adhere thereto to form a toner image.

Figure 5:
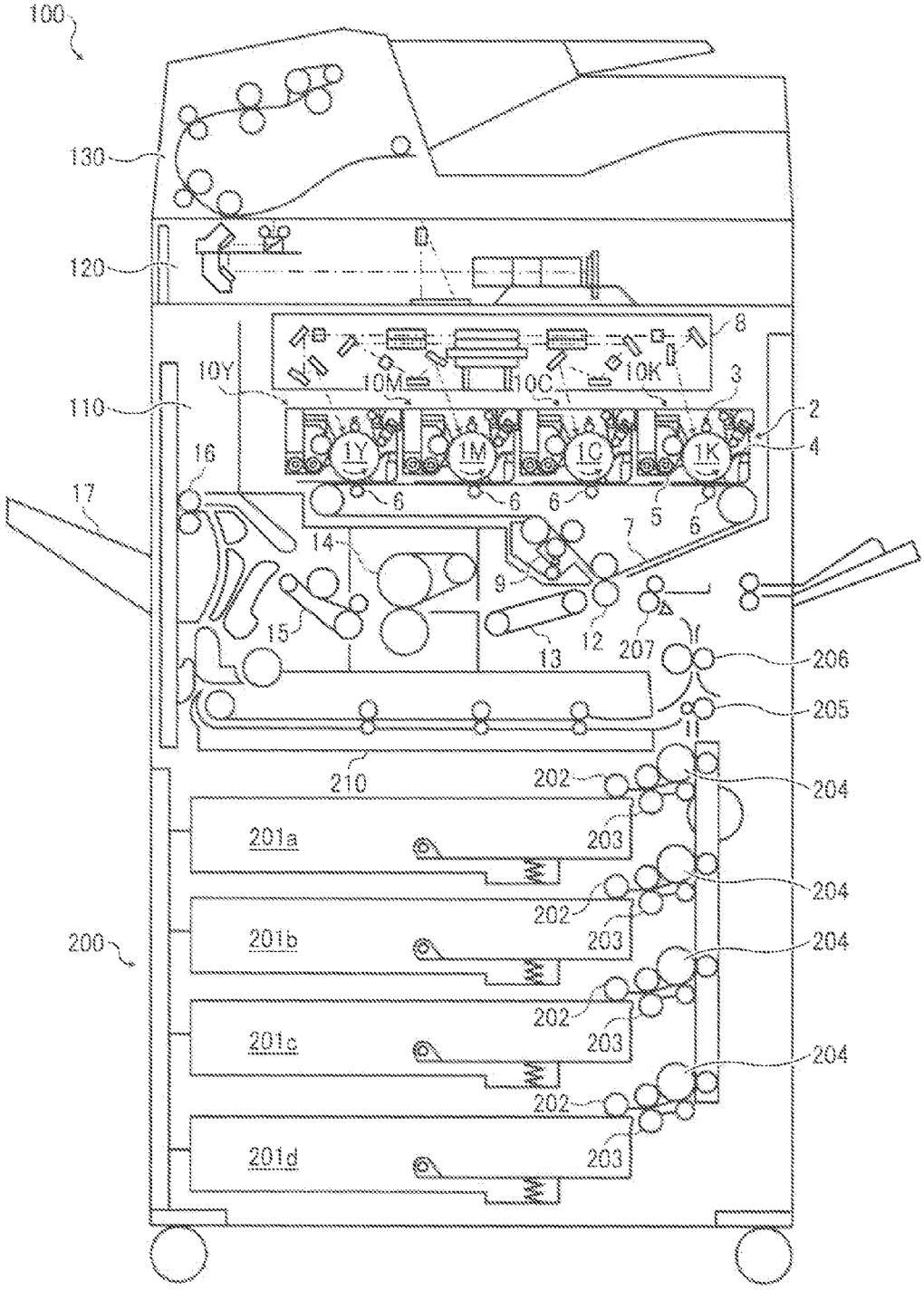
FIG. 5 schematically illustrates a cross-sectional view of an image forming apparatus according to a third exemplary embodiment.

FIG. 5 schematically illustrates a cross-sectional view of an image forming apparatus according to a third exemplary embodiment.

An image forming apparatus 100 illustrated in FIG. 5 in a copier that includes a printing part 110, a scanning part 120 provided above the printing part 110, an automatic document feeder (ADF) 130 provided above the scanning part 120, and a paper feed part 200 provided below the printing part 110. The image forming apparatus 100 has a communication function with an external device. When connected with an external personal computer, the image forming apparatus 100 functions as a printer or a scanner. When connected with a telephone line or an optical line, the image forming apparatus 100 functions as a facsimile machine.

Within the printing part 110, four image forming stations 10Y, 10M, 10C, and 10K that form respective toner images of yellow, magenta, cyan, and black are arranged in tandem. The toner images of yellow, magenta, cyan, and black are superimposed on one another on an intermediate transfer medium 7 to form a full-color image. More specifically, the image forming stations 10Y, 10M, 10C, and 10K are arranged in tandem along the belt-like intermediate transfer medium 7 that is stretched taut across multiple rollers. Toner images of yellow, magenta, cyan, and black formed in the respective image forming stations 10Y, 10M, 10C, and 10K are successively transferred onto the intermediate transfer medium 7 and superimposed on one another to form a composite full-color image. The full-color image is then transferred onto a sheet-like transfer medium by a secondary transfer device 12.

Each of the image forming stations 10Y, 10M, 10C, and 10K has the same configuration as the image forming part 10 illustrated in FIG. 4. Around each of photoreceptors 1Y, 1M, 1C, and 1K in the respective image forming stations 10Y, 10M, 10C, and 10K, a protective agent applicator 2, a charger 3, an exposure part to a laser light beam L directed from a latent image forming device 8, a developing device 5, a primary transfer device 6, and a cleaning device 4 are provided. As described above, the BN-containing protective agent is applied to one, two, or three of the photoreceptors 1Y, 1M, 1C, and 1K. The image forming stations 10Y, 10M, 10C, and 10K are comprised of the respective process cartridges 11Y, 11M, 11C, and 11K, not shown, each including the photoreceptor 1, the protective agent applicator 2, the cleaning device 4, the charger 3, and the developing device 5. The process cartridges 11Y, 11M, 11C, and 11K are detachably mounted on the printing part 110.

A series of image forming operations of the image forming apparatus 100 which employs a negative-positive process is described below.

In each of the image forming stations 10Y, 10M, 10C, and 10K, the photoreceptor 1 is neutralized by a neutralization lamp, not shown, and then uniformly charged to a negative potential by the charger 3. The photoreceptor 1 may be, for example, an organic photoreceptor (OPC) having an organic photoconductive layer.

The charger 3 charges the photoreceptor 1 upon application of a predetermined voltage to the charger 3 from a voltage application mechanism, not shown. The applied voltage may be overlapped with an alternate current voltage.

The charged photoreceptor 1 is exposed to a laser light beam emitted from the latent image forming device 8 so that a latent image is formed thereon. The absolute potential of the exposed portion is lower than that of non-exposed portions. The latent image forming device 8 may be comprised of, for example, multiple laser light sources, a coupling optical system, an optical deflector, and a scanning imaging optical system.

More specifically, the laser light beam emitted from the laser light source (e.g., a laser diode) is deflected by the optical deflector to scan the surface of the photoreceptor 1 in the axial direction of the photoreceptor 1 through the scanning imaging optical system. The optical deflector may be comprised of, for example, a high-speed rotary polygon mirror.

The latent image thus formed on the photoreceptor 1 is developed into a toner image with toner particles supplied from the developing roller 51 upon application of a developing bias to the developing roller 51 from a voltage application mechanism, not shown. The developing bias has a voltage between potentials of exposed and non-exposed portions, and may be optionally overlapped with an alternating current voltage.

The toner images of yellow, magenta, cyan, and black thus formed in the respective image forming stations 10Y, 10M, 10C, and 10K are successively transferred onto the intermediate transfer medium 7 by the primary transfer devices 6 and superimposed on one another to form a full-color toner image. At the same time, a sheet of a transfer medium (e.g., paper) is fed from one of multiple paper feed cassettes 201*a*, 201*b*, 201*c*, and 201*d* by one of paper feed mechanisms each comprised of a paper feed roller 202 and a separation roller 203 in the paper feed part 200, and the transfer medium is further fed to a secondary transfer area by feed rollers 204, 205, and 206 and a registration roller 207. In the secondary transfer area, the full-color toner image is transferred from the intermediate transfer medium 7 onto the transfer medium by a secondary transfer device 12. In the above-described primary and secondary transfer processes, a transfer bias is applied to both the primary transfer devices 6 and the secondary transfer device 12. The transfer bias may be a voltage having an opposite polarity to the toner in use.

The transfer medium having the full-color toner image thereon then separates from the intermediate transfer medium 7. On the other hand, residual toner particles remaining on the photoreceptor 1 after the primary transfer process are removed by the cleaning member 41 and collected in a toner collection chamber in the cleaning device 4. Further, residual toner particles remaining on the intermediate transfer medium 7 after the secondary transfer process are removed by a cleaning member and collected in a toner collection chamber in a cleaning device 9.

As described above, in the image forming apparatus 100, the image forming stations 10Y, 10M, 10C, and 10K are arranged in tandem along the intermediate transfer medium 7. Toner images of yellow, magenta, cyan, and black formed on the respective photoreceptors 1Y, 1M, 1C, and 1K are successively transferred onto the intermediate transfer medium 7 and superimposed on one another to form a full-color toner image. The full-color toner image is then transferred onto a transfer medium, such as paper. The transfer medium having the full-color toner image thereon is then conveyed to a fixing device 14 by a conveyance device 13, and the toner image is fixed on the transfer medium by application of heat. Then transfer medium on which the toner image is fixed is discharged onto a discharge tray 17 by a conveyance device 15 and a discharge roller 16.

When printing images on both sides of the transfer medium, a conveyance path below the fixing device 14 is switched so that a transfer medium having a toner image on one side is reversed upside down through a conveyance device 210. The upside-down transfer medium is then fed to the secondary transfer area again by the conveyance roller 206 and the registration roller 207 so that a toner image is transferred onto the other side of the transfer medium. Similarly, the transfer medium is fed to the fixing device 14 again to fix the toner image thereon, and then discharged onto the discharge tray 17.

The image forming apparatus 100 does not necessarily need the intermediate transfer medium 7. The intermediate transfer medium 7 may be replaced with, for example, a transfer belt that conveys a transfer medium. In that case, toner images of yellow, magenta, cyan, and black formed on the respective photoreceptors 1Y, 1M, 1C, and 1K are successively and directly transferred onto the transfer medium conveyed by the transfer belt. The transfer medium having the full-color toner image thereon is fed to the fixing device 14 to fix the toner image thereon.

Next, exemplary embodiments of the photoreceptor for use in the image forming apparatus or process cartridge according to this specification are described.

The photoreceptor includes a conductive substrate and a photosensitive layer. The photosensitive layer may be either a single layer containing both a charge generation material and a charge transport material, a normal multilayer comprised of a lower charge generation layer and an upper charge transport layer, or a reverse multilayer comprised of a lower charge transport layer and an upper charge generation layer. The photoreceptor may also include a surface layer above the photosensitive layer to improve mechanical strength, abrasion resistance, gas resistance, and cleanability. Further, the photoreceptor may include an undercoat layer between the photosensitive layer and the conductive substrate. Each of the layers may include a plasticizer, an antioxidant, a leveling agent, etc., if needed.

Suitable materials for the conductive substrate include conductive materials having a volume resistivity of $10^{10}$ Ω·cm or less. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxide, indium oxide, and the like, is formed by deposition or sputtering. In addition, a metal cylinder can also be used as the conductive substrate, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments.

The cylindrical conductive substrate preferably has a diameter of from 20 to 150 mm, more preferably from 24 to 100 mm, and most preferably from 28 to 70 mm. When the diameter is too small, it is spatially difficult to provide devices for charging, irradiating, developing, transferring, and cleaning around the photoreceptor. When the diameter is too large, the image forming apparatus may become too large. When multiple photoreceptors are mounted on a tandem image forming apparatus as illustrated in FIG. 5, each of the photoreceptors preferably has a diameter of 70 mm or less, more preferably 60 mm or less.

In addition, an endless nickel belt and an endless stainless steel belt disclosed in Examined Japanese Application Publication No. 52-36016, the disclosure thereof being incorporated herein by reference, can be also used as the conductive substrate.

The undercoat layer may be mainly comprised of a resin, or a mixture of a resin and a white pigment. Alternatively, the undercoat layer may be a metal oxide film which is formed by chemically or electrochemically oxidizing a surface of the conductive substrate. The white pigment may be, for example, a metal oxide such as titanium oxide, aluminum oxide, zirconium oxide, and zinc oxide. Among these metal oxides, titanium oxide is preferable because it prevents charge injection from the conductive substrate into the undercoat layer. Specific examples of suitable resins for the undercoat layer include, but are not limited to, thermoplastic resins such as polyamide, polyvinyl alcohol, casein, and methyl cellulose; thermosetting resins such as acryl, phenol, melamine, alkyd, unsaturated polyester, and epoxy; and mixtures thereof. The undercoat layer may be either a single layer or a multilayer.

Specific preferred materials suitable for the charge generation material include, but are not limited to, organic pigments and dyes such as azo pigments (e.g., monoazo pigments, bisazo pigments, trisazo pigments, tetrakisazo pigments), triarylmethane dyes, thiazine dyes, oxazine dyes, xanthene dyes, cyanine dyes, styryl dyes, pyrylium dyes, quinacridone pigments, indigo pigments, perylene pigments, polycyclic quinone pigments, benzimidazole pigments, indanthrone pigments, squarylium pigments, phthalocyanine pigments; and inorganic materials such as selenium, selenium-arsenic, selenium-tellurium, cadmium sulfide, zinc oxide, titanium oxide, and amorphous silicone. Two or more of these materials can be used in combination.

Specific preferred materials suitable for the charge transport material include, but are not limited to, anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. Two or more of these materials can be used in combination.

The charge generation layer and the charge transport layer may include a binder resin which is electrically insulative. Specific preferred materials suitable for the binder resin include, but are not limited to, thermoplastic resins such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, acrylic resin, methacrylic resin, polystyrene, polycarbonate, polyarylate, polysulfone, polyether sulfone, and ABS resin; thermosetting resins such as phenol resin, epoxy resin, urethane resin, melamine resin, isocyanate resin, alkyd resin, silicone resin, and thermosetting acrylic resin; photoconductive resins such as polyvinyl carbazole, polyvinyl anthracene, and polyvinyl pyrene; and photo-curable resins. Two or more of these materials can be used in combination.

Specific preferred materials suitable for the antioxidant include the following compounds (a) to (g), but are not limited thereto.

(a) Monophenol compounds: such as 2,6-di-t-butyl-p-cresol, butylated hydroxyanisole, 2,6-di-t-butyl-4-ethylphenol, stearyl-β-(3,5-di-t-butyl-4-hydroxyophenyl)propionate, and 3-t-butyl-4-hydroxyanisol.

(b) Bisphenol compounds: such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

(c) Polyphenol compounds: such as 1,1,3-tris-(2-methyl-4-hydroxy-5-t-butylphenyl)butane, 1,3,5-trimethyl-2,4,6-tris (3,5-di-t-butyl-4-hydroxybenzyl)benzene, tetrakis-[methylene-3-(3',5'-di-t-butyl-4'-hydroxyphenyl)propionate] methane, bis[3,3'-bis(4'-hydroxy-3'-t-butylphenyl)butyric acid]glycol ester, and tocopherols.

(d) Paraphenylenediamines: such as N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(e) Hydroquinones: such as 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(f) Organic sulfur compounds: such as dilauryl-3,3'-thiodipropionate, distearyl-3,3'-thiodipropionate, and ditetradecyl-3,3'-thiodipropionate.

(g) Organic phosphor compounds: such as triphenylphosphine, tri(nonylphenyl)phosphine, tri(dinonylphenyl)phosphine, tricresylphosphine, and tri(2,4-dibutylohenoxy)phosphine.

Specific preferred materials suitable for the plasticizer include, but are not limited to, dibutyl phthalate and dioctyl phthalate. The content of the plasticizer is preferably from 0 to 30 parts by weight, based on 100 parts by weight of the binder resin.

Specific preferred materials suitable for the leveling agent include, but are not limited to, silicone oils such as dimethyl silicone oil and methyl phenyl silicone oil, and polymers or oligomers having a side chain having a perfluoroalkyl group.

The content of the leveling agent is preferably from 0 to 1 part by weight, based on 100 parts by weight of the binder resin.

As described above, the photoreceptor may include a surface layer to improve mechanical strength, abrasion resistance, gas resistance, and cleanability. The surface layer may be a polymer layer having a greater mechanical strength than the photosensitive layer, or a polymer layer dispersing an inorganic filler, for example. The surface layer needs not necessarily have charge transportability when the surface layer is thin. However, the surface layer preferably includes a charge transport material or a charge transport polymer when the surface layer is thick, to prevent deterioration of sensitivity, increase of potential after exposure, or increase of residual potential.

Because the photosensitive layer has a lower mechanical strength than the surface layer, the surface layer is preferably thick as much as possible to prevent abrasion of the photosensitive layer. Accordingly, the surface layer preferably has a thickness of from 0.1 to 12 μm, more preferably from 1 to 10 μm, and most preferably from 2 to 8 μm. When the surface layer is too thin, the surface layer may be partially abraded by the cleaning blade, and the photosensitive layer thus exposed may be further abraded by the cleaning blade. When the surface layer is too thick, deterioration of sensitivity, increase of potential after exposure, or increase of residual potential is likely to occur.

Polymers having transparency, insulation property, mechanical strength, and adhesion property are suitable for the surface layer.

Specific examples of such polymers include, but are not limited to, polycarbonate, ABS resin, ACS resin, olefin-vinyl monomer copolymer, chlorinated polyether, allyl resin, phenol resin, polyacetal, polyamide, polyamide imide, polyacrylate, polyallyl sulfone, polybutylene, polybutylene terephthalate, polyether sulfone, polyethylene, polyethylene terephthalate, polyimide, acrylic resin, polymethylpentene, polypropylene, polyphenylene oxide, polysulfone, polystyrene, AS resin, butadiene-styrene copolymer, polyurethane, polyvinyl chloride, polyvinylidene chloride, and epoxy resin. These polymers may be either thermoplastic or thermosetting. In the latter case, the polymer should be cross-linked by a cross-linking agent having polyfunctional acryloyl, carboxyl, hydroxyl, or amino group, so that mechanical strength of the surface layer increases to be more resistant to friction and abrasion by the cleaning blade.

The surface layer may further include filler particles to improve mechanical strength. Specific preferred materials suitable for the filler include, but are not limited to, metal oxides such as alumina, titanium oxide, tin oxide, potassium titanate, $TiO_2$, TiN, zinc oxide, indium oxide, and antimony oxide.

To more improve abrasion resistance, the surface layer may further include a fluorocarbon resin (e.g., polytetrafluoroethylene) or a silicone resin, optionally dispersing an inorganic material therein.

Next, exemplary embodiments of the intermediate transfer medium for use in the image forming apparatus according to this specification are described.

Preferably, the intermediate transfer medium is conductive and has a volume resistivity of from $10^5$ to $10^{11}$ Ω·cm. When the volume conductivity is too small, toner particles may scatter when transferred from the photoreceptor onto the intermediate transfer medium due to electric discharge. When the volume conductivity is too large, charges opposed against toner images may remain on the intermediate transfer medium after the toner images are transferred from the intermediate transfer medium onto a recording medium such as paper, thereby producing residual images in a resulting image.

The intermediate transfer medium preferably has a surface resistivity of from $10^8$ to $10^{13}$ Ω/sq. When the surface resistivity is too small, toner particles may scatter when transferred from the photoreceptor onto the intermediate transfer medium. When the surface resistivity is too large, the primary transfer may not normally occur.

The intermediate transfer medium may be a belt-shaped or cylindrical plastic which is formed by kneading a metal oxide (e.g., tin oxide, indium oxide), a conductive particulate material (e.g., carbon black), and/or a conductive polymer with a thermoplastic resin, and extruding the kneaded mixture. As an alternative, the intermediate transfer medium may be an endless belt which is formed by heating and centrifugal-molding a resin solution containing thermally cross-linkable monomers or oligomers and optional conductive particulate materials and/or conductive polymers.

The intermediate transfer medium may have a surface layer. The surface layer of the intermediate transfer medium has a similar configuration to the surface layer of the photoreceptor except that the charge transport material is not included and a conductive material is optionally included for controlling resistivity.

Next, exemplary embodiments of the toner for use in the image forming apparatus or process cartridge according to this specification are described.

The toner preferably has an average circularity of from 0.93 to 1.00. Circularity is defined by the following equation:

$$\text{Circularity}=Cs/Cp$$

wherein Cp represents a circumferential length of a projected image of a toner particle and Cs represents a circumferential length of a circle having the same area as that of the projected image of the toner particle.

Circularity indicates the degree of roughness of a toner particle. When the toner particle is a sphere, the circularity is 1.00. As the toner particle becomes far from the sphere, the circularity decreases.

When the average circularity is between 0.93 and 1.00, it means that the toner particles have a smooth surface and the contact area between each toner particles or between the toner particle and a photoreceptor is small. Such toner particles can be effectively transferred from the photoreceptor onto a transfer medium.

Agitating such smooth toner particles in a developing device produces only a small torque. Therefore, the agitation can be kept stable without producing abnormal image. Because there is no angular toner particle, the transfer medium can uniformly press each of the toner particles that constitute dots. Thus, defective image is not produced. Additionally, such smooth toner particles do not damage or abrade a surface of the image bearing member.

The average circularity can be measured using a flow-type particle analyzer FPIA-1000 (from Sysmex Corporation), for example.

The toner preferably has a weight average particle diameter (D4) of from 3 to 10 μm, which is smaller enough for reliably reproducing micro dots of latent images.

When D4 is too small, such toner particles cannot be effectively transferred onto a transfer medium or removed from a photoreceptor by a blade member. When D4 is too large, such toner particles are likely to scatter when producing text or line images.

The ratio (D4/D1) of the weight average particle diameter (D4) to the number average particle diameter (D1) is preferably between 1.00 and 1.40. As the ratio D4/D1 approaches 1, the size distribution of the toner particles becomes narrower. When D4/D1 is between 1.00 and 1.40, it is not likely that toner particles having a certain size are selectively used for developing latent images, resulting in production of reliable images.

When the size distribution is narrow, the frictional charge distribution is also narrow, thus preventing image fogging. A narrow size distribution means that the particle diameters of each toner particles are substantially the same. Such toner particles can precisely and finely reproduce latent image dots.

The size distribution of the toner can be measured using instruments such as COULTER COUNTER TA-II or COULTER MULTISIZER II (from Beckman Coulter, Inc.).

The toner is preferably prepared by subjecting toner components, including a polyester prepolymer having a nitrogen-containing functional group, a polyester, a colorant, and a release agent, to cross-linking and/or elongation reactions in an aqueous medium containing a particulate resin. The toner prepared by such a method has a relatively hard surface, which can prevent the occurrence of hot offset. The hot offset here refers to an undesirable phenomenon in which part of a fused toner image is adhered to a surface of a fixing member and re-transferred onto an undesired portion of a recording medium.

The polyester prepolymer may be, for example, a polyester prepolymer (A) having an isocyanate group. The polyester prepolymer (A) cross-links and/or elongates with an amine (B) to produce a urea-modified polyester.

The polyester prepolymer (A) having an isocyanate group can be prepared by reacting a polyester having an active hydrogen group, which is a polycondensation product between a polyol (1) and a polycarboxylic acid (2), with a polyisocyanate (3).

The polyol (1) may be a diol (1-1) or a polyol (1-2) having 3 or more valences. A diol (1-1) alone or a mixture of a diol (1-1) with a small amount of a polyol (1-2) is preferable.

Specific examples of the diol (1-1) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the above alicyclic diols, and alkylene oxide (e.g., ethylene oxide, propylene oxide, butylene oxide) adducts of the above bisphenols. Among these diols, an alkylene glycol having 2 to 12 carbon atoms and an alkylene oxide adduct of a bisphenol are preferable, and an alkylene oxide adduct of a bisphenol alone, or a mixture of an alkylene oxide adduct of a bisphenol with an alkylene glycol having 2 to 12 carbon atoms is more preferable.

Specific examples of the polyol (1-2) having 3 or more valences include, but are not limited to, polyvalent aliphatic alcohols (e.g., glycerin, trimethylolethane, trimethylolpropane, pentaerythritol, sorbitol), polyphenols (e.g., trisphenol PA, phenol novolac, cresol novolac), and alkylene oxide adducts of the above polyphenols.

The polycarboxylic acid (2) may be a dicarboxylic acid (2-1) or a polycarboxylic acid (2-2) having 3 or more valences. A dicarboxylic acid (2-1) alone or a mixture of a dicarboxylic acid (2-1) with a small amount of a polycarboxylic acid (2-2) is preferable.

Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid).

Among these dicarboxylic acids, alkenylene dicarboxylic acids having 4 to 20 carbon atoms and aromatic dicarboxylic acids having 8 to 10 carbon atoms are preferable.

Specific examples of the polycarboxylic acid (2-2) having 3 or more valences include, but are not limited to, aromatic polycarboxylic acids having 9 to 20 carbon atoms (e.g., trimellitic acid, pyromellitic acid).

Additionally, the polycarboxylic acid (2) may be acid anhydrides or lower alkyl esters (e.g., methyl ester, ethyl ester, isopropyl ester) of the above-described diols (2-1) and polycarboxylic acids (2-2).

The equivalent ratio ([OH]/[COOH]) of hydroxyl groups [OH] in the polyol (1) to carboxyl groups [COOH] in the polycarboxylic acid (2) is 2/1 to 1/1, preferably from 1.5/1 to 1/1, and more preferably from 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, the above polyisocyanates blocked with phenol derivatives, oxime, or caprolactam. These compounds can be used alone or in combination.

The equivalent ratio ([NCO]/[OH]) of isocyanate groups [NCO] in the polyisocyanate (3) to hydroxyl groups [OH] in the polyester is preferably from 5/1 to 1/1, more preferably from 4/1 to 1.2/1, and most preferably from 2.5/1 to 1.5/1. When [NCO]/[OH] is too large, the toner may have poor low-temperature fixability. When [NCO]/[OH] is too small, the toner may have poor offset resistance.

The polyester prepolymer (A) having terminal isocyanate groups preferably includes the polyisocyanate (3) units in an amount of from 0.5 to 40% by weight, preferably from 1 to 30% by weight, and more preferably from 2 to 20% by weight. When the amount of the polyisocyanate (3) units is too small, the toner may have poor offset resistance, heat-resistant storage stability, and low-temperature fixability. When the amount of the polyisocyanate (3) units is too large, the toner may have poor low-temperature fixability.

The number of isocyanate groups included in one molecule of the polyester prepolymer (A) is preferably 1 or more, more preferably from 1.5 to 3, and most preferably from 1.8 to 2.5. When the number of isocyanate groups per molecule is too small, the resulting urea-modified polyester may have too small a molecular weight, and therefore the resulting toner may have poor hot offset resistance.

The amine (B) to be reacted with the polyester prepolymer (A) may be a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmetahne); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from any of the above-described amines (B1) to (B5) and a ketone (e.g., acetone, methyl ethyl ketone, methyl isobutyl ketone), and oxazoline compounds.

Among these amines (B), a diamine (B1) alone and a mixture of a diamine (B1) with a small amount of a polyamine (B2) having 3 or more valences are preferable.

To control the molecular weight of the urea-modified polyester resulting from the cross-linking and/or elongating reactions between the polyester prepolymer (A) and the amine (B), a reaction terminator can be used.

Specific preferred materials for the reaction terminator include, but are not limited to, monoamines (e.g., diethylamine, dibutylamine, butylamine, laurylamine) and blocked materials of these monoamines (e.g., ketimine compounds).

The equivalent ratio ([NCO]/[NHx]) of isocyanate groups [NCO] in the polyester prepolymer (A) to amino groups [NHx] in the amine (B) is preferably from 1/2 to 2/1, more preferably from 1.5/1 to 1/1.5, and most preferably from 1.2/1 to 1/1.2. When [NCO]/[NHx] is too large or small, the resulting urea-modified polyester may have too small a molecular weight, and therefore the resulting toner may have poor hot offset resistance.

The urea-modified polyester may include urethane bonds other than urea bonds. In such a case, the molar ratio of urea bonds to urethane bonds is preferably from 100/0 to 10/90, more preferably from 80/20 to 20/80, and most preferably from 60/40 to 30/70. When the molar ratio of urea bonds is too small, hot offset resistance of the toner may decrease.

The urea-modified polyester preferably has a weight average molecular weight of 10,000 or more, more preferably from 20,000 to 10,000,000, and most preferably from 30,000 to 1,000,000. When the weight average molecular weight is too small, hot offset resistance of the toner may be poor.

The urea-modified polyester may be hereinafter referred to as the urea-modified polyester (i) for the sake of clarity. The toner may include a unmodified polyester (ii) in combination with the urea-modified polyester (i). In this case, the number average molecular weight of the urea-modified polyester (i) is not limited to any particular value. When only the urea-modified polyester (i) is included in the toner, the urea-modified polyester (i) preferably has a number average molecular weight of 20,000 or less, more preferably from 1,000 to 10,000, and most preferably from 2,000 to 8,000. When the number average molecular weight is too large, low-temperature fixability of the toner may be poor and the resulting full-color images may have low gloss.

The combination of the urea-modified polyester (i) and the unmodified polyester (ii) improves the resulting image gloss compared to a case where the urea-modified polyester (i) is used alone. The unmodified polyester (ii) may also be a polycondensation product between the polyol (1) and the polycarboxylic acid (2). The unmodified polyester (ii) may have any chemical bonds other than urea bonds, for example, urethane bonds. It is preferable that the urea-modified polyester (i) and the unmodified polyester (ii) are partially or completely compatible with each other from the viewpoint of low-temperature fixability and hot offset resistance of the toner. Therefore, the urea-modified polyester (i) and the unmodified polyester (ii) preferably have a similar chemical composition. The weight ratio of the urea-modified polyester (i) to the unmodified polyester (ii) is preferably from 5/95 to 80/20, more preferably from 5/95 to 30/70, much more preferably from 5/95 to 25/75, and most preferably from 7/93 to 20/80. When the amount of the urea-modified polyester (i) is too small, hot offset resistance, heat-resistant storage stability, and low-temperature fixability of the toner may be poor.

The unmodified polyester (ii) preferably has a peak molecular weight of from 1,000 to 30,000, more preferably from 1,500 to 10,000, and most preferably from 2,000 to 8,000. When the peak molecular weight is too small, heat-resistant storage stability of the toner may be poor. When the peak molecular weight is too large, low-temperature fixability of the toner may be poor.

The unmodified polyester (ii) preferably has a hydroxyl value of 5 or more, more preferably from 10 to 120, and most preferably from 20 to 80. When the hydroxyl value is too small, both heat-resistant storage stability and low-temperature fixability of the toner may be poor.

The unmodified polyester (ii) preferably has an acid value of from 1 to 30, and more preferably from 5 to 20, so that the resulting toner is negatively chargeable.

The binder resin (i.e., the urea-modified polyester (i) and the optional unmodified polyester (ii)) preferably has a glass transition temperature (Tg) of from 50 to 70° C., more preferably from 55 to 65° C. When Tg is too low, the toner may cause blocking when stored at high temperatures. When Tg is too high, low-temperature fixability of the toner may be poor. Because the above-prepared toner includes the urea-modified polyester (i), heat-resistance storage stability is better compared to typical polyester-based toners even when Tg is relatively small.

A temperature at which the storage elastic modulus (TG') of the binder resin becomes 10,000 dyne/cm$^2$ is preferably 100° C. or more, more preferably from 110 to 200° C., at a frequency of 20 Hz. When the temperature is too low, hot offset resistance of the resulting toner may be poor.

A temperature at which the viscosity (Tn) of the binder resin becomes 1,000 poises is preferably 180° C. or less, more preferably from 90 to 160° C., at a frequency of 20 Hz. When the temperature is too high, low-temperature fixability of the resulting toner may be poor.

Accordingly, when the temperature at which the storage elastic modulus (TG') of the binder resin becomes 10,000 dyne/cm$^2$ is higher than the temperature at which the viscosity (Tn) of the binder resin becomes 1,000 poises, both low-temperature fixability and hot offset resistance of the resulting toner are good. Specifically, the difference between the above two temperatures is preferably from 0 to 100° C., more preferably from 10 to 90° C., and most preferably from 20 to 80° C.

A polycondensation reaction between the polyol (1) and the polycarboxylic acid (2) is undergone at a temperature of from 150 to 280° C. in the presence of an esterification catalyst (e.g., tetrabutoxy titanate, dibutyltin oxide), while optionally reducing pressure and removing produced water, to prepare a polyester having hydroxyl groups. The polyester having hydroxyl group further reacts with the polyisocyanate (3) at a temperature of from 40 to 140° C. to prepare the polyester prepolymer (A) having an isocyanate group. The polyester prepolymer (A) having an isocyanate group further reacts with the amine at a temperature of from 0 to 140° C. to prepare the urea-modified polyester.

When reacting the polyester with the polyisocyanate (3), or reacting the polyester prepolymer (A) with the amine (B), solvents can be used, if needed. Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive against the polyisocyanate (3).

One exemplary method of manufacturing the above-described toner which uses an aqueous medium is described below.

The aqueous medium may be water alone or a mixture of water with a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The polyester prepolymer (A) having an isocyanate group may react with the amine (B) in the aqueous medium in the process of forming toner particles. Alternatively, they may be previously reacted to produce the urea-modified polyester (i) before forming toner particles.

Toner components including the urea-modified polyester (i) or the polyester prepolymer (A) are dispersed in the aqueous medium upon application of shearing force. The toner components including the urea-modified polyester (i) or the polyester prepolymer (A), the unmodified polyester (ii), a colorant or a colorant master batch, a release agent, a charge controlling agent, etc., may be mixed at the time being dispersed in the aqueous medium. Alternatively, the toner components may be previously mixed before dispersed in the aqueous medium. The colorant, release agent, and charge control agent may not necessarily be dispersed in the aqueous medium. Such materials may be added after toner particles are formed. For example, toner particles can be formed without colorant and dyed with a colorant in a succeeding process.

The toner components are dispersed in the aqueous medium using a low-speed shearing disperser, a high-speed shearing disperser, a frictional disperser, a high-pressure jet disperser, or an ultrasonic disperser, for example. A high-speed shearing disperser is preferable for controlling the particle diameter of the dispersing oil droplets into 2 to 20 μm. In this case, the revolution is preferably from 1,000 to 30,000 rpm, and more preferably from 5,000 to 20,000 rpm. The dispersing time is preferably from 0.1 to 5 minutes. The dispersing temperature is preferably from 0 to 150° C. (under pressure), and more preferably from 40 to 98° C. The higher the dispersing temperature, the lower the viscosity of the dispersion, which is more preferable.

The used amount of the aqueous medium is preferably from 50 to 2,000 parts by weight, more preferably from 100 to 1,000 parts by weight, based on 100 parts by weight of the toner components. When the used amount of the aqueous medium is too small, the toner components cannot be finely dispersed in the aqueous medium, and therefore desired-size particles cannot be obtained. When the used amount of the aqueous medium is too large, it may result in a cost increase.

A disperser may be added to the aqueous medium so that toner particles having a narrower size distribution are reliably obtained.

The amine (B) may react with the polyester prepolymer (A) before the toner components are dispersed in the aqueous medium. Alternatively, the amine (B) may be react with the polyester prepolymer (A) in the aqueous medium after the toner components are dispersed therein. In the latter case, the resulting urea-modified polyester (i) is dominantly located on the surface of the resulting toner, generating a gradient of urea bonds.

Specific examples of usable dispersers include, but are not limited to, anionic surfactants (e.g., alkylbenzene sulfonate, α-olefin sulfonate, phosphate), amine salt type cationic surfactants (e.g., alkylamine salts, amino alcohol fatty acid derivatives, polyamine fatty acids derivatives, imidazoline), quaternary ammonium salt type cationic surfactants (e.g., alkyl trimethyl ammonium salt, dialkyl dimethyl ammonium salt, alkyl dimethyl benzyl ammonium salt, pyridinium salt, alkyl isoquinolinium salt, benzethonium chloride), nonionic surfactants (e.g., fatty acid amide derivatives, polyol derivatives), and ampholytic surfactants (e.g., alanine, dodecyl di(aminoethyl)glycine, di(octyl aminoethyl)glycine, N-alkyl-N,N-dimethyl ammonium betaine).

Surfactants having a fluoroalkyl group are also usable as the disperser. Specific examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl (C6-C10)-N-ethyl sulfonyl glycine salts, and monoperfluoroalkyl(C6-C16) ethyl phosphates.

Specific examples of commercially available such anionic surfactants having a fluoroalkyl group include, but are not limited to, SURFLON® S-111, S-112, and S-113 (from AGC Seimi Chemical Co., Ltd.); FLUORAD™ FC-93, FC-95, FC-98, and FC-129 (from Sumitomo 3M); UNIDYNE™ DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of cationic surfactants having a fluoroalkyl group include, but are not limited to, aliphatic primary, secondary, and tertiary amine acids having a fluoroalkyl group; and aliphatic tertiary ammonium salts such as perfluoroalkyl(C6-C10) sulfonamide propyl trimethyl ammonium salts, benzalkonium salts, benzethonium chlorides, pyridinium salts, and imidazolinium salts.

Specific examples of commercially available such cationic surfactants having a fluoroalkyl group include, but are not limited to, SURFLON® S-121 (from AGC Seimi Chemical Co., Ltd.); FLUORAD™ FC-135 (from Sumitomo 3M); UNIDYNE™ DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Inorganic compounds, such as tricalcium phosphate, calcium carbonate, titanium oxide, colloidal silica, and hydroxyapatite, are also usable as the disperser.

Additionally, polymeric protection colloids are also usable so as to more stabilize the dispersing oil droplets.

Specific examples of usable polymeric protection colloids include, but are not limited to, homopolymers and copolymers obtained from monomers, such as acid monomers (e.g., acrylic acid, methacrylic acid, a-cyanoacrylic acid, a-cyanomethacrylic acid, itaconic acid, crotonic acid, fumaric acid, maleic acid, maleic anhydride), acrylate and methacrylate monomers having hydroxyl group (e.g., β-hydroxyethyl acrylate, hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl ether monomers (e.g., vinyl methyl ether, vinyl ethyl ether, vinyl propyl ether), vinyl carboxylate monomers (e.g., vinyl acetate, vinyl propionate, vinyl butyrate), amide monomers (e.g., acrylamide, methacrylamide, diacetone acrylamide) and methylol compounds thereof, acid chloride monomers (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylene-based resins (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

In a case in which an acid-soluble or alkali-soluble compound (e.g., calcium phosphate) is used as the disperser, preferably, the resulting toner particles are first washed with an acid (e.g., hydrochloric acid) or an alkali and then washed with water. Alternatively, such a disperser can be removed with an enzyme.

The disperser may remain on the surface of the resulting toner. However, it is preferable that the disperser is washed or removed after the termination of the elongation and/or crosslinking reaction, in terms of chargeability of the toner.

To further reduce the viscosity of the toner components to obtain toner particles with a narrower size distribution, solvents which can dissolve the urea-modified polyester (i) and/or the polyester prepolymer (A) are preferably used. Preferably, the solvents are volatile, because such solvents are easily removable.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. Among these solvents, aromatic solvents (e.g., toluene, xylene) and halogenated hydrocarbons (e.g., methylene chloride, 1,2-dichloroethane, chloroform, carbon tetrachloride) are preferable. The used amount of the solvent is preferably from 0 to 300 parts by weight, more preferably from 0 to 100 parts by weight, and most preferably from 25 to 70 parts by weight, based on 100 parts by weight of the polyester prepolymer (A). The solvent is removed by application of heat at normal or reduced pressures after the termination of the elongation and/or crosslinking reaction.

The elongation and/or crosslinking reaction time between the polyester prepolymer (A) and the amine (B) is preferably from 10 minutes to 40 hours, and more preferably from 2 to 24 hours. The reaction temperature is preferably from 0 to 150° C., and more preferably from 40 to 98° C. A catalyst (e.g., dibutyltin laurate, dioctyltin laurate) can be used, if needed.

The solvent can be removed from the resulting emulsion by gradually heating the emulsion to completely evaporate the solvent from liquid droplets. Alternatively, the solvent can be removed from the emulsion by spraying the emulsion into dry atmosphere to completely evaporate the solvent from liquid droplets. In the latter case, aqueous dispersers, if any, can also be evaporated. The dry atmosphere into which the emulsion is sprayed may be, for example, air, nitrogen gas, carbon dioxide gas, or combustion gas, which is heated to above the maximum boiling point among the solvents. Such a treatment can be reliably performed by a spray drier, a belt drier, or a rotary kiln, within a short period of time.

In a case in which the emulsion is subjected to washing and drying treatments while containing toner particles having a wide size distribution, the toner particles are preferably subjected to a classification treatment.

Specifically, the classification treatment removes undesired-size particles from the resulting particles in a liquid by a cyclone, a decanter, or a centrifugal separator. Of course, the classification treatment can be performed after drying the resulting particles, but is more effectively performed in a liquid. The collected undesired-size particles, either in dry or wet condition, can be reused for preparation of toner particles. The disperser is preferably removed in the process of the classification treatment.

The dried toner particles are optionally mixed with fine particles of a release agent, a charge controlling agent, a fluidizer, and/or a colorant, and these fine particles can be fixedly adhered to the surfaces of the toner particles by application of mechanical impulsive force.

Mechanical impulsive force can be applied by agitating toner particles using blades rotating at a high speed, or accelerating toner particles by a high-speed airflow to collide with a collision plate. Such a treatment can be performed by ONG MILL (from Hosokawa Micron Co., Ltd.), a modified I TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

As described above, the toner may include a colorant. Specific examples of usable colorants include, but are not limited to, carbon black, lamp black, iron black, ultramarine, nigrosine dyes, aniline blue, phthalocyanine blue, phthalocyanine green, hansa yellow G, rhodamine 6C lake, calco oil blue, chrome yellow, quinacridone red, benzidine yellow, and rose bengal. Two or more of these colorants can be used in combination.

The toner may include a magnetic material to have magnetic properties. Specific examples of usable magnetic materials include, but are not limited to, iron oxides (e.g., ferrite, magnetite, hematite), and metals (e.g., iron, cobalt, nickel) and alloys or mixtures thereof with other metals. These magnetic materials can also be used as the colorant.

The colorant particles dispersed in the toner preferably have a number average particle diameter of 0.5 μm or less, more preferably 0.4 μm or less, and most preferably 0.3 μm or less.

When the number average particle diameter is too large, the toner may have poor transparency. When the amount of large colorant particles is too large, such colorant particles may release from the toner and cause image fogging, contamination of the photoreceptor, etc. Preferably, the content of colorant particles having a particle diameter greater than 0.7 μm is 10% by number or less, more preferably 5% by number or less.

The colorant may be previously kneaded with a binder resin partially or entirely, along with a wetting liquid, so that the colorant and the binder resin adhere to each other from the early period. Thus, the colorant can be effectively and finely dispersed in toner particles in the succeeding toner manufacturing processes, resulting in production of more transparent toner particles.

Suitable binder resins may be the same as those suitable for the toner binder, but are not limited thereto.

For example, the binder resin, colorant, and wetting liquid may be first mixed by a blender (e.g., HENSCHEL MIXER), and the resulting mixture may be then kneaded by a kneader (e.g., a double roll kneader, a three roll kneader) at a temperature lower than the melting point of the binder resin.

The wetting liquid may be, for example, an organic solvent (e.g., acetone, toluene, butanone) or water, in view of solubility to the binder resin and wettability to the colorant. Water is much more preferable from the viewpoint of environmental consideration and its reliable dispersing ability.

Through the above process, the colorant can be uniformly dispersed in the toner with a small particle size, resulting in more transparent projected images.

As described above, the toner may include a release agent. The release agent may be, for example, a polyolefin wax (e.g., polyethylene wax, polypropylene wax), a long-chain hydrocarbon (e.g., paraffin wax, SAZOL wax), and a wax having a carbonyl group.

Among the above materials, a wax having a carbonyl group is most preferable. Specific examples of the wax having a carbonyl group include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine, dibehenyl amide), and dialkyl ketones (e.g., distearyl ketone).

Among the above waxes having a carbonyl group, polyalkanoic acid esters are preferable. The release agent preferably has a melting point of from 40 to 160° C., more preferably from 50 to 120° C., and most preferably from 60 to 90° C. When the melting point is too low, heat-resistant storage stability of the toner may be poor. When the melting point is too high, the toner may cause cold offset when fixed at low temperatures. The release agent preferably has a melt viscosity of from 5 to 1,000 cps, more preferably from 10 to 100 cps, at a temperature 20° C. higher than the melting point. When the melt viscosity is too large, hot offset resistance and low temperature fixability of the toner may be poor. The content of the release agent in the toner is preferably from 0 to 40% by weight, and more preferably from 3 to 30% by weight.

The toner may include a charge controlling agent so that the toner can be quickly charged. Preferably, the charge controlling agent is a transparent or whitish material so as not to change the color tone of the toner.

Specific examples of usable charge controlling agents include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and metal salts of salicylic acid derivatives.

Specific examples of commercially available charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, and a quaternary ammonium group.

The content of the charge controlling agent is preferably from 0.1 to 10 parts by weight, more preferably from 0.2 to 5 parts by weight, based on 100 parts by weight of the binder resin. When the content of charge controlling agent is too large, the toner may be excessively charged and electrostatically attracted to a developing roller, resulting in poor fluidity of the toner and low image density.

The charge controlling agent may be melt-kneaded with the above-described colorant master batch, or directly mixed with the other toner components. Alternatively, the toner controlling agent may be fixed on toner particles which are formed without charge controlling agent.

The aqueous medium that disperses the toner components may contain a particulate resin as a dispersion stabilizer.

The particulate resin may be comprised of a resin dispersible in aqueous media. Specific examples of such resins include, but are not limited to, thermoplastic and thermosetting resins such as vinyl resin, polyurethane resin, epoxy resin, polyester resin, polyamide resin, polyimide resin, silicon-containing resin, phenol resin, melamine resin, urea resin, aniline resin, ionomer resin, and polycarbonate resin. Two or more of such resins can be used in combination. Among these resins, vinyl resin, polyurethane resin, epoxy resin, and polyester resin are preferable because they are easy to form an aqueous dispersion containing fine spherical particles.

The vinyl resin is a homopolymer or copolymer of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

To more improve fluidity, developability, and chargeability of the toner, an external additive may be added to the surface of the toner. Specific preferred materials suitable for the external additive include particulate inorganic materials.

The particulate inorganic materials preferably have a primary diameter of from 5 mμ to 2 μm, and more preferably from 5 to 500 mμ, and a BET specific surface area of from 20 to 500 $m^2/g$. The content of the particulate inorganic material is preferably from 0.01 to 5% by weight, more preferably from 0.01 to 2.0% by weight, based on the toner.

Specific examples of usable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Additionally, particles of polymers prepared by soap-free emulsion polymerization, suspension polymerization, or dispersion polymerization (e.g., polystyrene, copolymers of methacrylates or acrylates), polycondensation polymers (e.g., silicone, benzoguanamine, nylon), and thermosetting resins are also usable as the external additive.

The external additive may be surface-treated with a hydrophobizing agent so that fluidity and chargeability of the toner may not deteriorate even under high-humidity conditions. Specific examples of usable hydrophobizing agents include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so that residual toner particles remaining on a photoreceptor or primary transfer medium after image transfer are easily removable. Specific preferred materials suitable for the cleanability improving agent include, but are not limited to, metal salts of fatty acids (e.g., zinc stearate, calcium stearate), and fine particles of polymers prepared by soap-free emulsion polymerization (e.g., polymethyl methacrylate, polystyrene). Such fine particles of polymers preferably have a narrow size distribution and a volume average particle diameter of from 0.01 to 1 μm.

The above-described toner produces high-quality images. However, a part of the toner particles may remain on the photoreceptor without transferred onto the transfer medium or the intermediate transfer medium, and such toner particles are difficult to remove by a cleaning member due to their fineness and rolling motion. Therefore, the cleaning member (e.g., a blade) is pressed against the photoreceptor at a relatively high pressure, which results in short lifespan of the photoreceptor and the cleaning member and energy waste.

When the cleaning member is pressed against the photoreceptor at a lower pressure, residual toner particles may pass through the cleaning member and scrape the surface of the photoreceptor.

In addition to the above described toner, toners manufactured through what is called a pulverization process can also be used. In the pulverization process, first, the binder resin is mixed with other toner components such as a colorant, a release agent, and a charge controlling agent. The mixture is kneaded at a temperature below the melting point of the binder resin, followed by cooling. The kneaded mixture is pulverized into particles, and the particles are classified by size. Desired-size particles are collected and mixed with an external additive, thus preparing a toner.

Specific preferred binder resins suitable for such toners include, but are not limited to, homopolymers of styrene and styrene derivatives (e.g., polystyrene, poly(p-chlorostyrene), poly vinyltoluene), styrene copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-maleic acid copolymer), homopolymers and copolymers of acrylates (e.g., polymethyl acrylate, polybutyl acrylate, polymethyl methacrylate, polybutyl methacrylate), polyvinyl derivatives (e.g., polyvinyl chloride, polyvinyl acetate), polyester resins, polyurethane resins, polyamide resins, polyimide resins, polyol resins, epoxy resins, terpene resins, aliphatic and alicyclic hydrocarbon resins, and aromatic petroleum resins. Two or more of these binder resins can be used in combination. Among these binder resins, styrene-acrylic copolymer resins, polyester resins, and polyol resins are preferable from the viewpoint of electric property and cost. Polyester and polyol resins are also preferable from the viewpoint of fixability.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Photoreceptor

An aluminum cylinder (i.e., a conductive substrate) having a diameter of 40 mm was dip-coated with an undercoat layer coating liquid including 6 parts of an alkyd resin (BECKOSOL 1307-60-EL from DIC Corporation), 4 parts of a melamine resin (SUPER BECKAMINE G-821-60 from DIC Corporation), 40 parts of a titanium oxide, and 200 parts of methyl ethyl ketone, followed by drying, to form an undercoat layer.

Next, the undercoat layer was dip-coated with a charge generation layer coating liquid including 2 parts of a Y-type oxotitanyl phthalocyanine pigment, 0.2 parts of a polyvinyl butyral (S-LEC BM-S from Sekisui Chemical Co., Ltd.), and 50 parts of tetrahydrofuran, followed by drying, to form a charge generation layer.

Next, the charge generation layer was dip-coated with a charge transport layer coating liquid including 10 parts of a bisphenol A-type polycarbonate (PANLITE K1300 from Teijin Limited), 10 parts of a low-molecular-weight charge transport material (1) having the following formula, and 100 parts of methylene chloride, followed by drying, to form a charge transport layer.

(1)

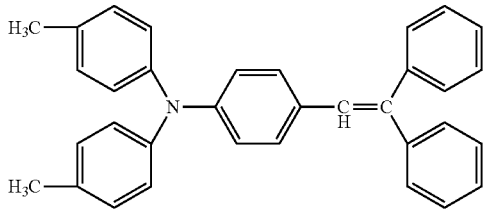

Next, the charge transport layer was spray-coated with a surface layer coating liquid including 10 parts of a polycarbonate, 7 parts of a low-molecular-weight charge transport material (1) having the following formula (I), 6 parts of fine particles of alumina (having an average particle diameter of 0.30 μm), 0.08 parts of a dispersing auxiliary agent (BYK-P104 from BYK Japan KK), 700 parts of tetrahydrofuran, and 200 parts of cyclohexane, followed by drying, to form a surface layer.

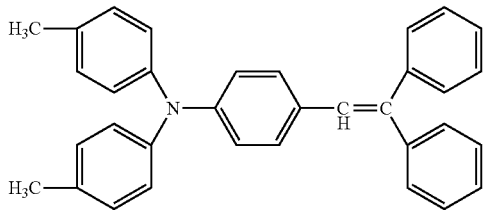

(1)

Thus, a photoreceptor including the undercoat layer having a thickness of 3.6 μm, the charge generation layer having a thickness of 0.14 μm, the charge transport layer having a thickness of 23 μm, and the surface layer having a thickness of 3.5 μm was prepared.

Preparation of Protective Agent Bar (1)

An aluminum mold having an inner dimension of 8 mm×350 mm was filled with a metal soap comprising 55 parts of zinc stearate and 45 parts of zinc palmitate. The metal soap was compressed by a hydraulic pressing machine so that the resulting metal soap block had an absolute specific gravity of 95% that of the metal soap. The resulting metal soap block had a thickness of 7 mm.

Both ends in the longitudinal direction and the bottom surface of the metal soap block were cut so that a protective agent bar (1) having a size of 7 mm×8 mm×310 mm was obtained. The bottom surface of the protective agent bar (1) was fixed to a metallic support by a double-faced tape.

Preparation of Protective Agent Bars (2) to (4)

The procedure in preparation of the protective agent bar (1) was repeated except that the aluminum mold was filled with a mixture of the metal soap comprising 55 parts of zinc stearate and 45 parts of zinc palmitate, and boron nitride. The mixing ratio between the metal soap and boron nitride is shown in Table 1. Thus, protective agent bars (2) to (4) were prepared.

Preparation of Protective Agent Bars (5) to (6)

The procedure in preparation of the protective agent bar (1) was repeated except that the aluminum mold was filled with a mixture of the metal soap comprising 55 parts of zinc stearate and 45 parts of zinc palmitate, boron nitride, and alumina particles. The mixing ratio between the metal soap, boron nitride, and alumina particles are shown in Table 1. Thus, protective agent bars (5) to (6) were prepared.

TABLE 1

| Protective Agent Bar No. | Mixing Ratio (Metal Soap/BN) | Content of Alumina based on Total Weight |
|---|---|---|
| 1 | — | — |
| 2 | 95/5 | — |
| 3 | 59/41 | — |
| 4 | 98/2 | — |
| 5 | 63/37 | 4% |
| 6 | 80/20 | 4% |

The above-prepared protective agent bars each were mounted on a tandem full-color image forming apparatus IMAGIO MPC5000 (from Ricoh Co., Ltd.) including multiple image forming stations (i.e., process cartridges) equipped with respective protective agent applicators.

Figure 6:
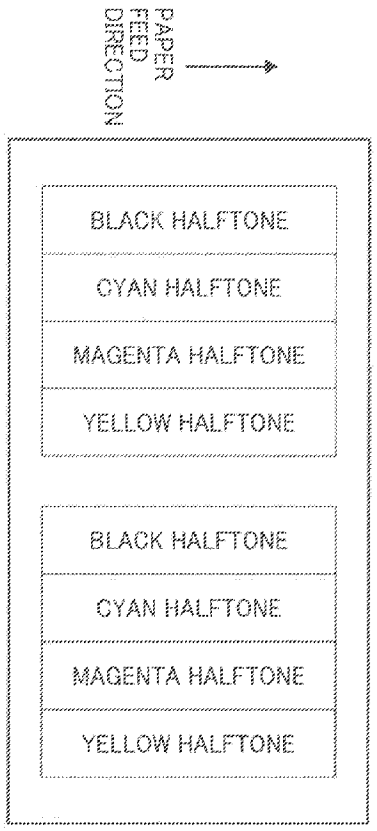
FIG. 6 illustrates a test chart used for evaluation in exemplary embodiments.

A test chart which can be downloaded from the Committee ISO/IEC JTC 001/SC 28 "Office equipment" website (http://www.iso.org/jtcl/sc28) and another test chart illustrated in FIG. 6 were printed for evaluation, at a low-temperature low-humidity condition, i.e., at 15° C., 30% RH.

The experimental conditions and evaluation results in Examples 1 to 8 and Comparative Example 1 are shown in Tables 2 and 3, respectively.

TABLE 2

| | Protective Agent Bar No. | | | | | |
|---|---|---|---|---|---|---|
| | Yellow Station (Extreme upstream) | Magenta Station | Cyan Station | Black Station | Blade Angle | Linear Speed (mm/sec) |
| Example 1 | 1 | 1 | 1 | 2 | 90° | 230 |
| Example 2 | 3 | 1 | 1 | 1 | 90° | 230 |
| Example 3 | 1 | 1 | 1 | 4 | 90° | 230 |
| Example 4 | 1 | 1 | 1 | 5 | 120° | 230 |
| Example 5 | 1 | 1 | 1 | 6 | 90° | 230 |
| Example 6 | 1 | 1 | 1 | 6 | 90° | 345 |
| Example 7 | 5 | 1 | 1 | 5 | 90° | 345 |
| Example 8 | 2 | 2 | 2 | 1 | 120° | 230 |
| Comparative Example 1 | 1 | 1 | 1 | 1 | 90° | 230 |

TABLE 3

| | Boron Nitride Detection | | | | Image Quality | |
|---|---|---|---|---|---|---|
| | Yellow Station (Extreme upstream) | Magenta Station | Cyan Station | Black Station | 50,000$^{th}$ sheet | 100,000$^{th}$ sheet |
| Example 1 | Yes | Yes | Yes | Yes | A | A |
| Example 2 | Yes | Yes | Yes | Yes | A | B |
| Example 3 | Yes | Yes | Yes | Yes | A | B |
| Example 4 | Yes | Yes | Yes | Yes | A | A |
| Example 5 | Yes | Yes | Yes | Yes | A | A |
| Example 6 | Yes | Yes | Yes | Yes | A | A |
| Example 7 | Yes | Yes | Yes | Yes | A | A |
| Example 8 | Yes | Yes | Yes | Yes | A | A |
| Comparative Example 1 | | Unevaluated | | | C | C |

In Examples 1-5 and 8, the ISO chart and the chart illustrated in FIG. 6 were printed on 50,000 sheets of paper. In Examples 4 and 8, the genuine blade of IMAGIO MPC5000 having an angle of 90° was replaced with another obtuse blade having an angle of 120°. Observation of the 50,000$^{th}$ sheet revealed that image quality was high. Further, the ISO chart and the chart illustrated in FIG. 6 were printed on another 50,000 sheets of paper. Observation of the 100,000$^{th}$ sheet in total revealed that image quality was still high.

In Examples 6 and 7, the linear speed of all the photoreceptors was increased to 345 mm/sec from the original setting 230 mm/sec. Similarly, the ISO chart and the chart illustrated in FIG. 6 were printed on 50,000 sheets of paper. Observation of the 50,000$^{th}$ sheet revealed that image quality was high. Further, the ISO chart and the chart illustrated in FIG. 6 were printed on another 50,000 sheets of paper. Observation of the 100,000$^{th}$ sheet in total revealed that image quality was still high.

In Examples 1 to 8, after printing 100,000 sheets, each of the photoreceptors was coated with KBr powder to collect residues remaining thereon. The KBr powder having collected the residues was pelletized and subject to an analysis using an instrument FT/IR 6100 (from JASCO Corporation). The analysis revealed that boron nitride was detected in all the photoreceptors of yellow, magenta, cyan, and black. Although the charging roller was found to be slightly contaminated, there was no influence on the resulting image.

Microscope observation of the 50,000$^{th}$ image produced in each of Examples 1 to 8 revealed that there was no particular difference in image quality between each 50,000$^{th}$ image.

Microscope observation of the 100,000$^{th}$ image produced in each of Examples 1 to 8 revealed that dots were expanded in Example 2 and dot density was nonuniform in Example 3, while dots were precisely reproduced in Examples 1 and 4-8. Such differences could not be recognized by visual observation.

In Table 3, image quality is graded into the following three levels.

A: High-quality image.

B: Dot density was nonuniform when observed with a microscope, which was not visually observable. No problem in practical use.

C: Abnormal image.

In Comparative Example 1, the ISO chart and the chart illustrated in FIG. 6 were printed on 50,000 sheets of paper. Observation of the 50,000$^{th}$ sheet revealed that undesired white lines were produced. Further, the ISO chart and the chart illustrated in FIG. 6 were printed on another 50,000 sheets of paper. Observation of the 100,000$^{th}$ sheet in total revealed that undesired white lines were more considerably produced. The charging roller was also found to be contaminated with white linear substances.

Additional modifications and variations of the present invention are possible in light of the above teachings. It is therefore to be understood that within the scope of the appended claims the invention may be practiced other than as specifically described herein.

What is claimed is:

1. An image forming apparatus, comprising:

multiple photoreceptors;

multiple chargers that charge the respective photoreceptors;

a latent image forming device that forms respective latent images on the respective charged photoreceptors;

multiple developing devices that develop the respective latent images into respective toner images;

multiple transfer devices that transfer the respective toner images onto an intermediate transfer member;

multiple cleaning devices that remove residues remaining on the respective photoreceptors after transferring the respective toner images therefrom; and one or more BN-containing protective agent applicators that apply a BN-containing protective agent comprising a metal soap and boron nitride to the respective photoreceptors, wherein a total number of the photoreceptors is N, N being an integer of 2 or more, and a total number of the BN-containing protective agent applicators is a number in $\{1, \ldots, N-1\}$ when N is greater than 2, and is equal to 1 when N=2.

2. The image forming apparatus according to claim 1, further comprising one or more protective agent applicators that apply a protective agent consisting essentially of a metal soap to the respective photoreceptors other than those to which the BN-containing protective agent is applied.

3. The image forming apparatus according to claim 1, wherein the BN-containing protective agent is applied to at least one of the photoreceptors which forms black images.

4. The image forming apparatus according to claim 1, wherein the BN-containing protective agent is applied to at least an extreme upstream photoreceptor.

5. The image forming apparatus according to claim 1, wherein a weight ratio of the metal soap to the born nitride in the BN-containing protective agent is between 60/40 to 97/3.

6. The image forming apparatus according to claim 1, wherein the metal soap comprises zinc palmitate and zinc stearate.

7. The image forming apparatus according to claim 1, wherein the BN-containing protective agent applicators each comprise:

a solid bar comprised of the BN-containing protective agent; and a rotary brush contacted against the solid bar, that supplies the BN-containing protective agent to the respective photoreceptors by rotation.

8. The image forming apparatus according to claim 7, wherein the BN-containing protective agent applicators each further comprise an application blade that extends the BN-containing protective agent over the photoreceptor.

9. The image forming apparatus according to claim 8, wherein the application blade is coated with a lubricant.

10. The image forming apparatus according to claim 8, wherein the application blade is coated with boron nitride or a mixture of a metal soap and boron nitride.

11. The image forming apparatus according to claim 8, wherein the application blade contacts the photoreceptor so as to face in a direction of rotation of the photoreceptor.

12. The image forming apparatus according to claim 8, wherein the application blade has an obtuse edge.

13. The image forming apparatus according to claim 7, wherein the solid bar is prepared by compressing the BN-containing protective agent in a powdery state.

14. The image forming apparatus according to claim 13, wherein the solid bar has an absolute specific gravity of from 88 to 98% that of the BN-containing protective agent in a powdery state.

15. The image forming apparatus according to claim 1, wherein the BN-containing protective agent further includes abrasive particles.

16. The image forming apparatus according to claim 15, wherein the abrasive particles are alumina.

17. The image forming apparatus according to claim 1, wherein each of the chargers is in contact with or adjacent to the respective photoreceptors, and charges the respective photoreceptors by alternate current discharge in which an alternate current voltage is overlapped with a direct current voltage.

18. The image forming apparatus according to claim 1, wherein each of the photoreceptors includes a filler in its outermost layer.

19. An apparatus, comprising:

multiple photoreceptors that bear respective latent images;

multiple developing devices that develop the respective latent images into respective toner images; and at least one BN-containing protective agent applicator that applies a BN-containing protective agent comprising a metal soap and boron nitride to the respective photoreceptors, wherein a total number of the photoreceptors is N, N being an integer of 2 or more, and a total number of the BN-containing protective agent applicators is a number in $\{1, \ldots, N-1\}$ when N is greater than 2, and is equal to 1 when N=2.

* * * * *